US006908589B2

(12) United States Patent
Kitudo et al.

(10) Patent No.: US 6,908,589 B2
(45) Date of Patent: Jun. 21, 2005

(54) HIGH MANGANESE CAST IRON CONTAINING SPHEROIDAL VANADIUM CARBIDE AND METHOD FOR MAKING THEROF

(75) Inventors: Tadashi Kitudo, Sakai (JP); Mamoru Takemura, Tondabayashi (JP); Mituaki Matumuro, Kashihara (JP); Hideto Matumoto, Settsu (JP); Takao Horie, Gifu (JP); Kazumichi Shimizu, Oita (JP)

(73) Assignees: Osaka Prefecture, Osaka (JP); Kabushiki Kaisha Sankyogokin Chuzoasho, Osaka (JP); Okamoto Co., Ltd., Gifu (JP)

( * ) Notice: Subject to any disclaimer, the term of this patent is extended or adjusted under 35 U.S.C. 154(b) by 203 days.

(21) Appl. No.: 10/461,622

(22) Filed: Jun. 13, 2003

(65) Prior Publication Data

US 2004/0151612 A1 Aug. 5, 2004

(30) Foreign Application Priority Data

Jan. 30, 2003 (JP) ..... 2003-022639

(51) Int. Cl.[7] ..... C22C 37/10; C22C 37/04

(52) U.S. Cl. ..... 420/13; 420/10; 420/12; 420/14; 420/72; 420/73; 420/75; 148/619; 148/329; 148/321

(58) Field of Search ..... 148/337, 324, 148/321; 420/10, 12, 13, 72, 73, 75, 32, 619, 27, 18, 14–16

(56) References Cited

U.S. PATENT DOCUMENTS

| | | | | |
|---|---|---|---|---|
| 5,308,408 A | * | 5/1994 | Katila | 148/328 |
| 6,406,563 B2 | * | 6/2002 | Kawano et al. | 148/324 |
| 6,511,544 B2 | * | 1/2003 | McKee et al. | 118/665 |
| 6,761,777 B1 | * | 7/2004 | Radon | 148/325 |

* cited by examiner

*Primary Examiner*—Deborah Yee
(74) *Attorney, Agent, or Firm*—Curtis L. Harrington

(57) ABSTRACT

The purpose of the present invention is to provide high manganese cast iron containing spheroidal vanadium carbide and method for making which is nonmagnetic as well as superior mechanical properties such as wear-resistance and toughness, and further does not require a water toughing heat treatment which has been needed when nonmagnetic high manganese steel (high manganese cast steel) is obtained by crystallized spheroidal vanadium in austenite matrix, and the high manganese cast iron containing spheroidal vanadium carbide is comprised of C 1.5~4.0 weight %, V 6~15 weight %, Si 0.2~4.0 weight %, Mn 10~18 weight %, Mg 0.01~0.1 weight %, remaining iron (Fe) and inevitable impurities, spheroidal vanadium carbide is crystallized within a structure.

6 Claims, 22 Drawing Sheets

Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Vanadium Contents and Carbon Contents on Relative Wear-Resistance Ratio Effect of Impact Angles on Wear Weight Losses of Comparative Examples 1 and 2, and Example 7

Effect of Impact Angles on Wear Weight Losses of Comparative Examples 1 and 2 , and Example 15

Result of X-Ray Diffraction Test of Example 9

Result of X-Ray Diffraction Test of Example 11

Effect of Vanadium Contents on Magnetic Permeability

HIGH MANGANESE CAST IRON CONTAINING SPHEROIDAL VANADIUM CARBIDE AND METHOD FOR MAKING THEROF

BACKGROUND OF THE INVENTION

1. Field of the Invention

The present invention relates to high manganese cast iron containing spheroidal vanadium carbide and method for making thereof, and its object is to provide the high manganese cast iron containing spheroidal vanadium carbide and method for making thereof that had superior mechanical properties such as abrasion-resistance and toughness and nonmagnetic properties by crystallizing spheroidal vanadium carbide in an austenite matrix, and is not needed water toughening heat treating which has been needed when nonmagnetic high manganese steel (high manganese cast steel) is obtained.

2. Description of the Related Art

The high manganese steel (high manganese cast steel) containing manganese which is more than 10 weight % is known as Hadfield steel. The Hadfield steel contains C within the range of 0.9~1.4 weight %, and Mn 10~15 weight %, the high manganese iron containing C 1.1~1.2 weight % and M 12~13 weight % is manufactured most for an economical reason.

The Hadfield steel can be manufactured by casting, forging or rolling. However, as the Hadfield steel remains molded condition, ferrous carbide precipitates at crystal grain boundary and a part of austenite matrix transforms into martensite. As a result, tensile strength is 400~500 N/mm$^2$ and elongation is less than 1% and the Hadfield steel becomes embrittled. Consequently, heat treatment(called water toughening) which carries out water quenching around from 1273~1473 K is necessary (Iron and Steel Institute of Japan. "Heat treatment of steel". Maruzen Co., Ltd., 1981.p.447–450).

The Hadfield steel manufactured by water-cooling process around at 1273~1473 K has an austenite matrix, and its toughness, work hardenability and wear-resistance are superior. Further, proof strength is 295 N/mm$^2$, and about 100 N/mm$^2$ larger than 18-8 stainless steel.

Since the Hadfield steel is nonmagnetic, it is used as a structural material of a superconducting device, linear motor track or cryogenic strong magnetic field. Magnetic permeability is less than 1.5 and hardly changes even if the Hadfield steel is machined.

At present, 14 Mn system, 18 Mn system, 25 Mn system, etc. among the high manganese steel (high manganese cast steel) are known, and further, Ni, Cr, Nb, V, N, etc. are added to the high manganese steel according to the purpose or the use.

For example, ASTM A-128 (1969) D etc. to which nickel is added are known. JIS G-5131 (1969) SCMnH11, SCMnH21, ASTMA-128 (1969) C, etc. are known as added Cr. The JIS G-5131 (1969) SCMnH21 etc. is known as added V.

As an example added various alloy elements to the high manganese steel (high manganese cast steel), there is a research report of the solidification structure and solidification process of an alloy which was added C 1.2~5.0 weight % and V 0~7.5% to Fe-12 weight % Mn (Akira Sawamoto, et al. "Solidification Structures of High Manganese-Vanadium Cast Steels" Casting. No. 54. Vol 3, 1982.p. 167–172).

On the other hand, in a patent application No. 2001-204291, the applicants provided spheroidal carbide cast iron which is consisted of C 0.6~4.0 weight %, V 4~15 weight %, Al 0.05~1.0 weight %, Mg 0.01~0.2 weight %, Si 0.2~4.5 weight %, Cr 13~30 weight %, Mn 0.2~3.0 weight %, Ni 4~15 weight %, remaining iron (Fe) and inevitable impurities and which the covalent binding spheroidal vanadium carbide is crystallized in its structure of cast iron. This spheroidal carbide cast iron had enough properties such as corrosion-resistance, wear-resistance and toughness.

However, in above-mentioned high manganese steel (high manganese cast steel) has following problems. First, the high manganese steel (high manganese cast steel) has caused work hardening on a steel surface by impact load, and has caused wear-resistance. Therefore, its wear-resistance is inferior in circumstances like sliding wear and abrasive wear which do not cause work hardening. Further, when the high manganese steel has been produced by casting, there are much ferrous carbide is precipitated and mechanical properties deteriorated. The heat treatment called water toughening which removes ferrous carbide was required.

Unless heat treatment called water toughening is carried out, the high manganese steel is embrittled and moreover, magnetic permeability is 1.5~2.5.Therefore, nonmagnetic high manganese steel cannot be obtained.

After a devoted study in order to solve above-mentioned problems, the applicants found that by applying spheroidizing process of the vanadium carbide which has been found out previously by the applicants to the high manganese cast steel, the high manganese cast iron containing spheroidal vanadium carbide crystallized in the austenite matrix is obtained, and this high manganese cast iron is nonmagnetic, and superior mechanical properties such as wear-resistance and toughness without heat treatment called water toughening which is required in manufacturing of conventional high manganese cast iron. As a result, the present invention has been accomplished.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DESCRIPTION OF PREFERRED EMBODIMENTS OF THE INVENTION

Figure 1:
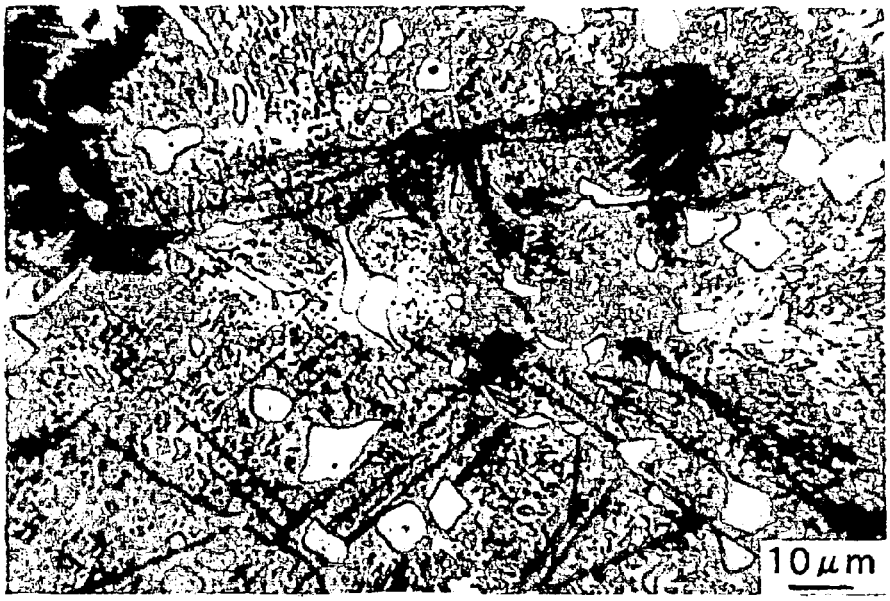
FIG. 1 is an optical micrograph of metal structure of Example 1.
Figure 2:
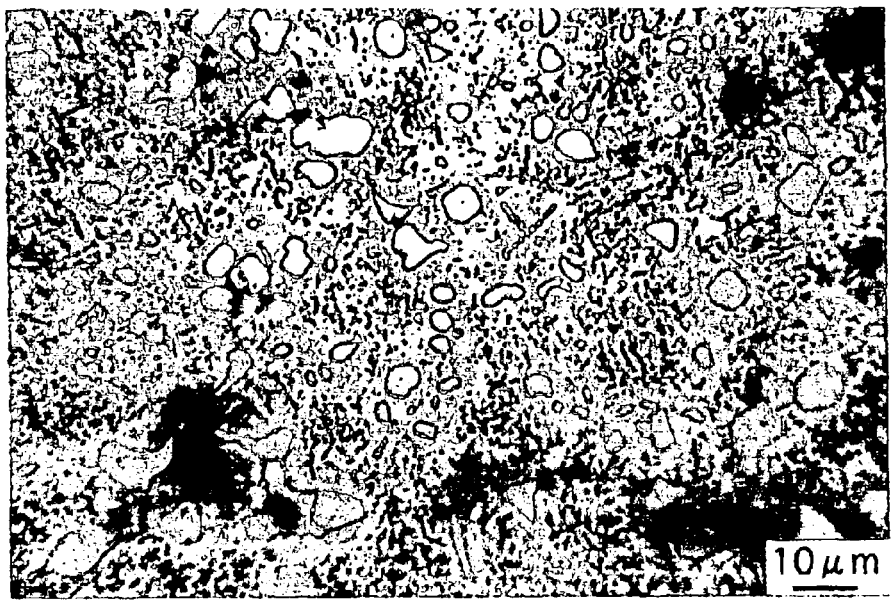
FIG. 2 is an optical micrograph of metal structure of Example 2.
Figure 3:
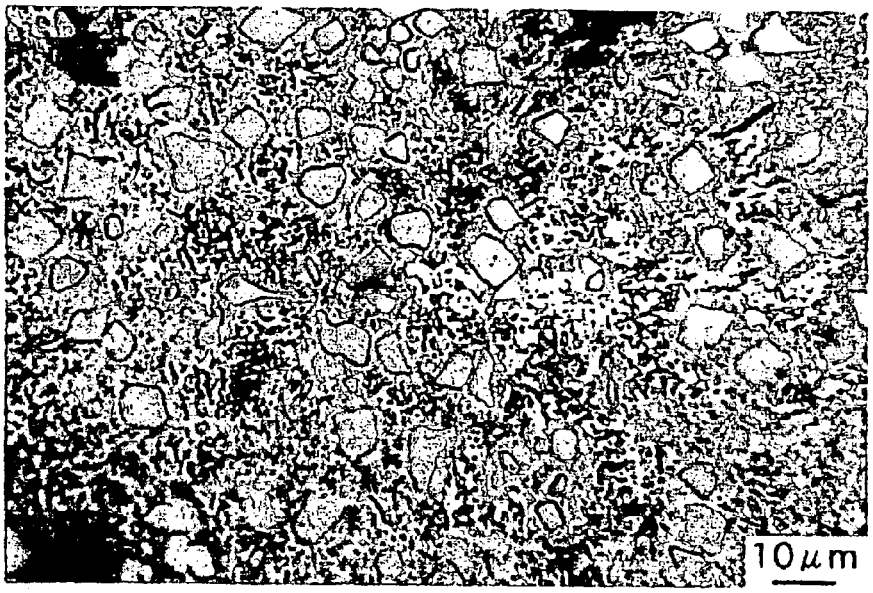
FIG. 3 is an optical micrograph of metal structure of Example 3.
Figure 4:
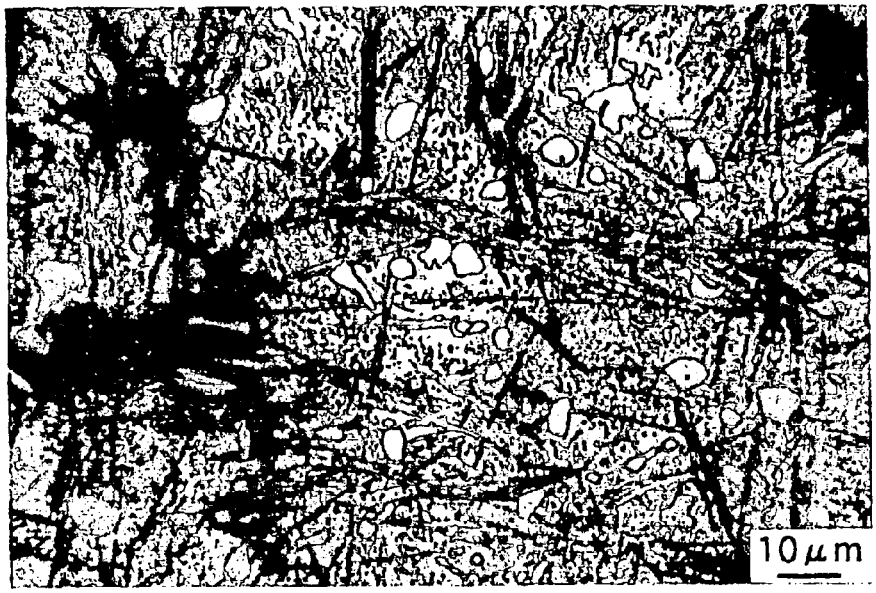
FIG. 4 is an optical micrograph of metal structure of Example 4.
Figure 5:
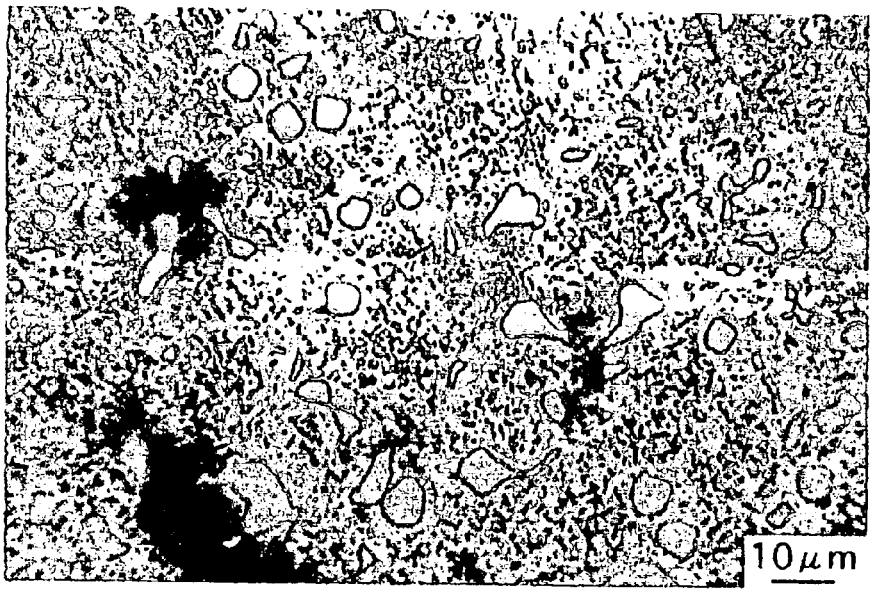
FIG. 5 is an optical micrograph of metal structure of Example 5.
Figure 6:
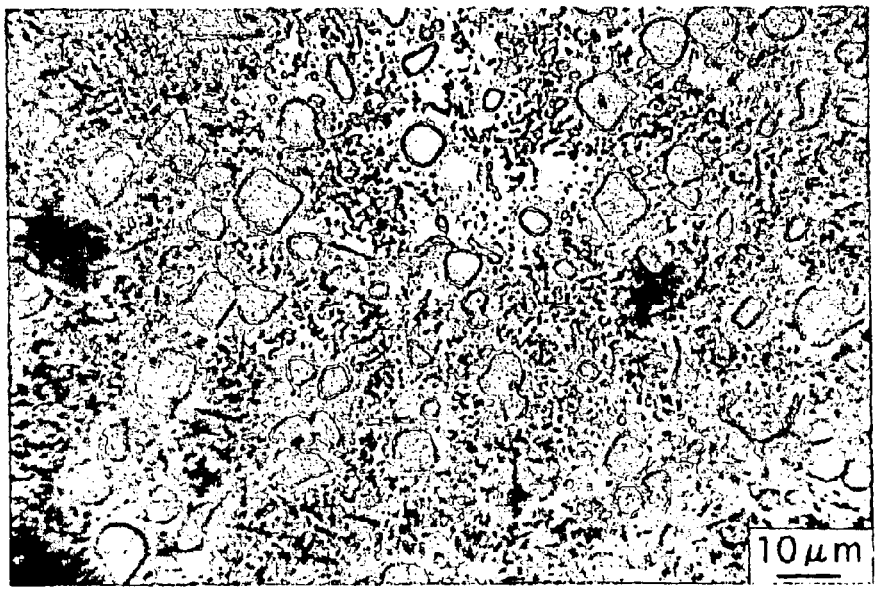
FIG. 6 is an optical micrograph of metal structure of Example 6.
Figure 7:
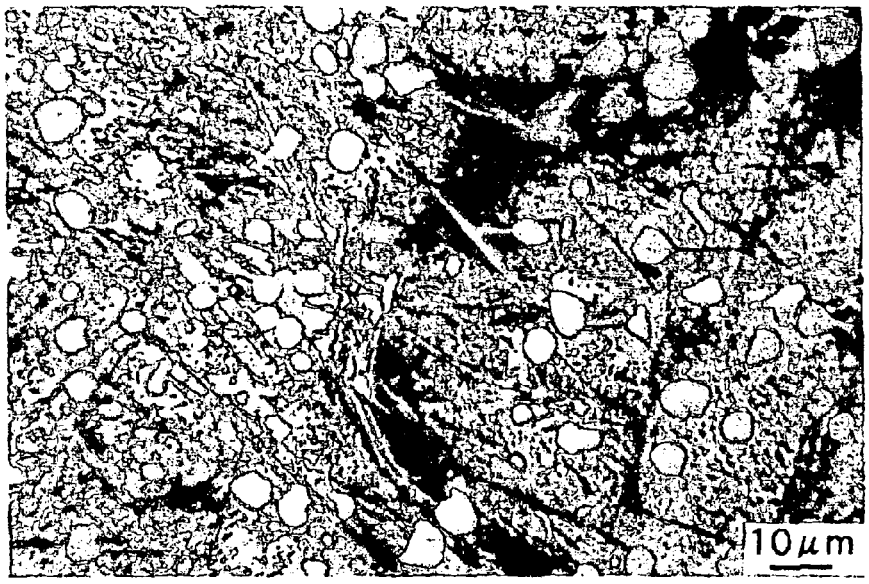
FIG. 7 is an optical micrograph of metal structure of Example 7.
Figure 8:
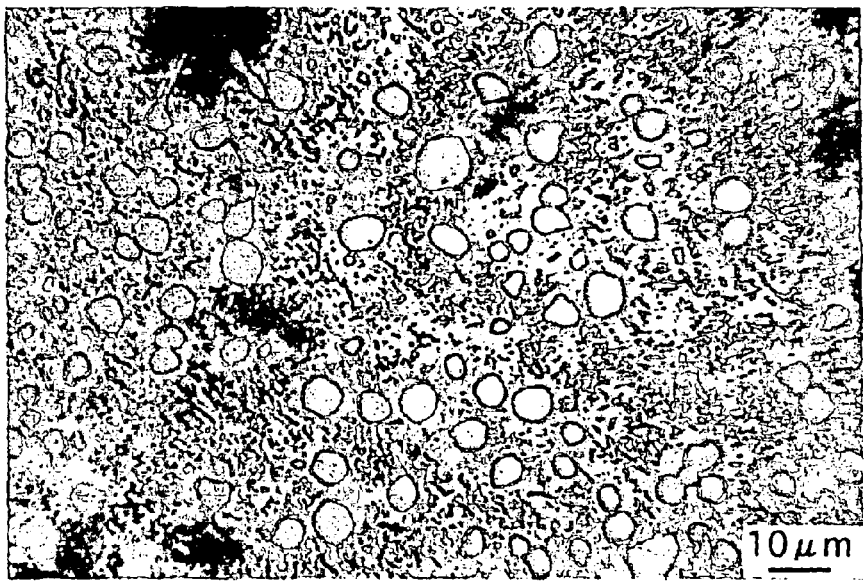
FIG. 8 is an optical micrograph of metal structure of Example 8.
Figure 9:
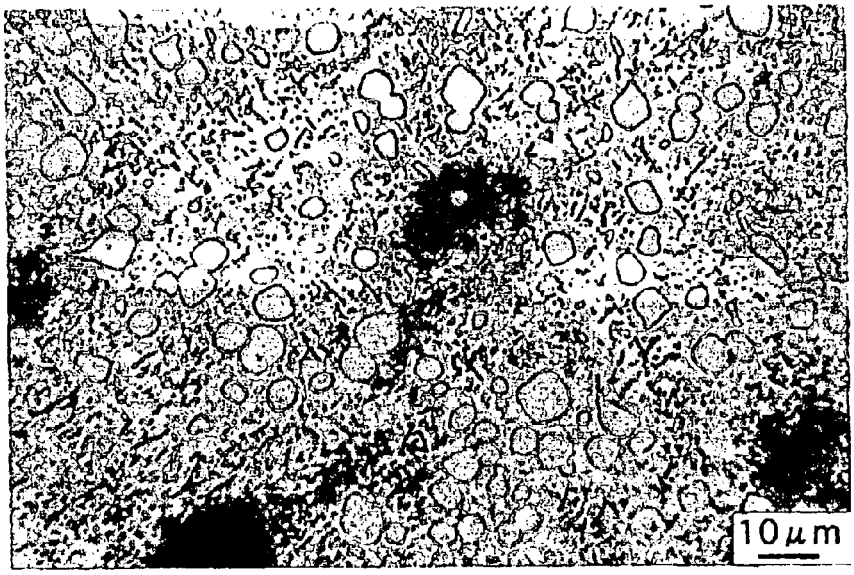
FIG. 9 is an optical micrograph of metal structure of Example 9.
Figure 10:
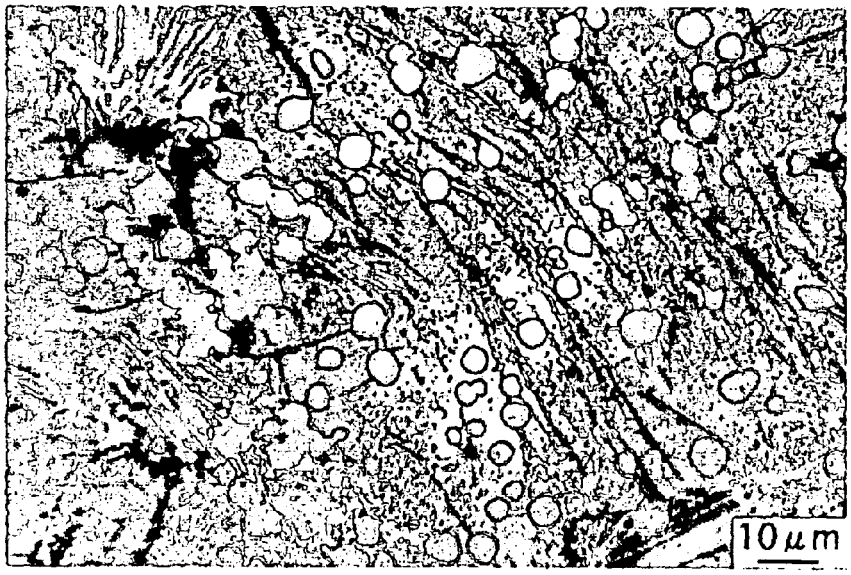
FIG. 10 is an optical micrograph of metal structure of Example 10.
Figure 11:
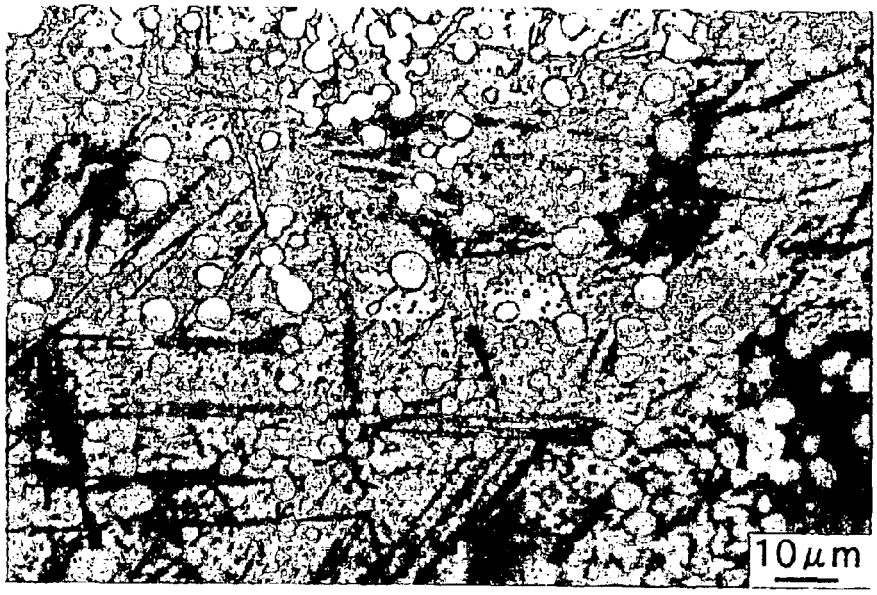
FIG. 11 is an optical micrograph of metal structure of Example 11.
Figure 12:
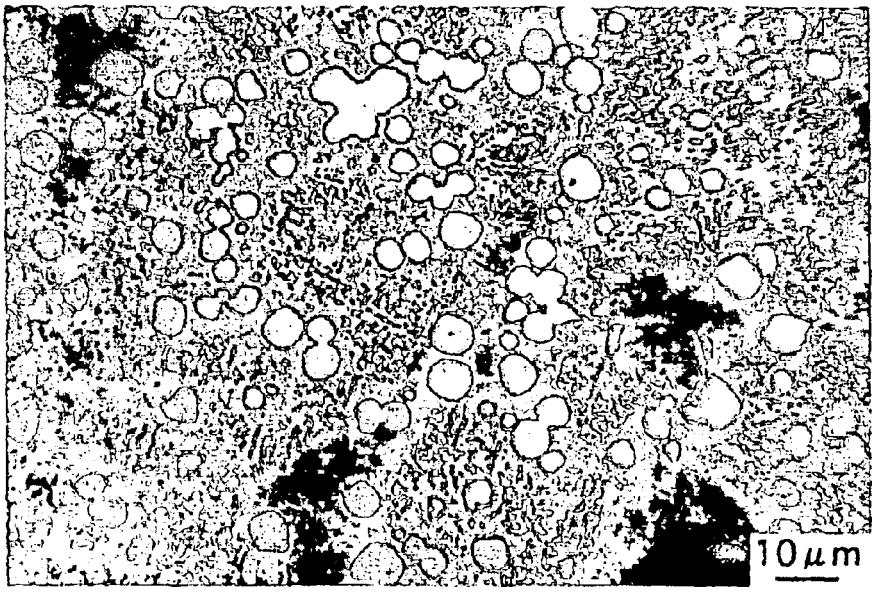
FIG. 12 is an optical micrograph of metal structure of Example 12.
Figure 13:
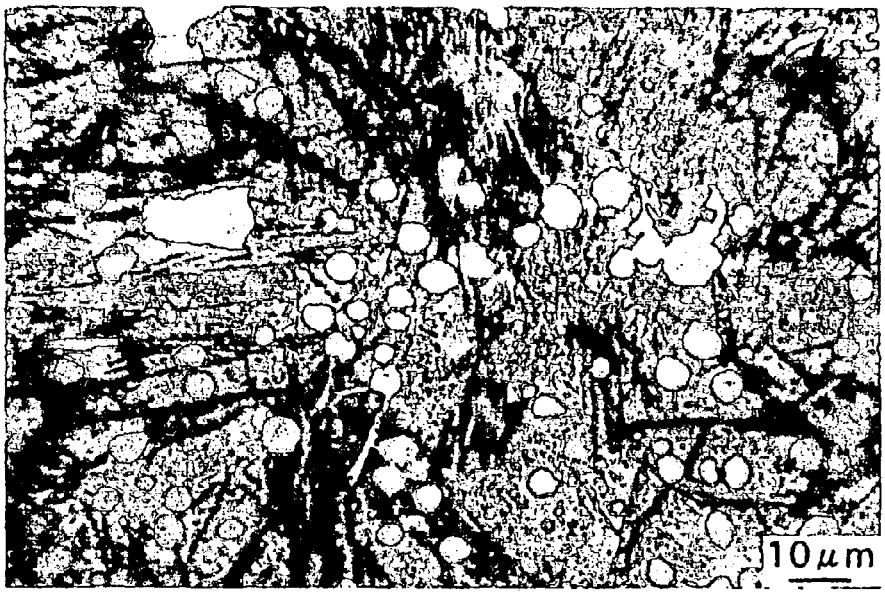
FIG. 13 is an optical micrograph of metal structure of Example 13.
Figure 14:
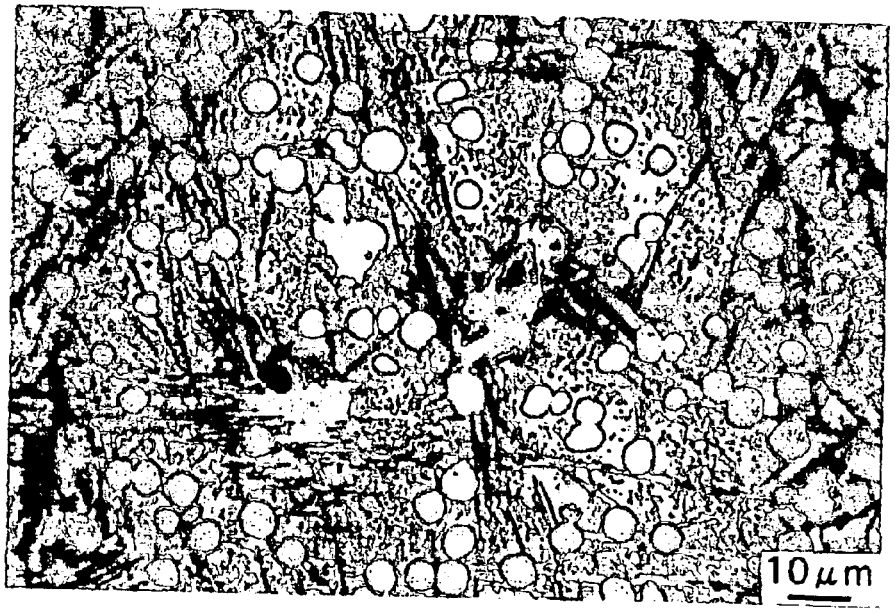
FIG. 14 is an optical micrograph of metal structure of Example 14.
Figure 15:
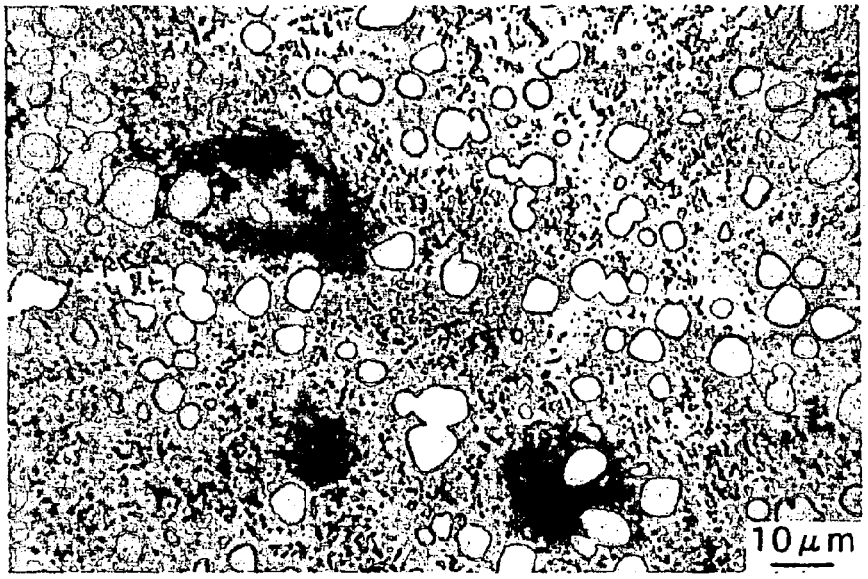
FIG. 15 is an optical micrograph of metal structure of Example 15.
Figure 16:
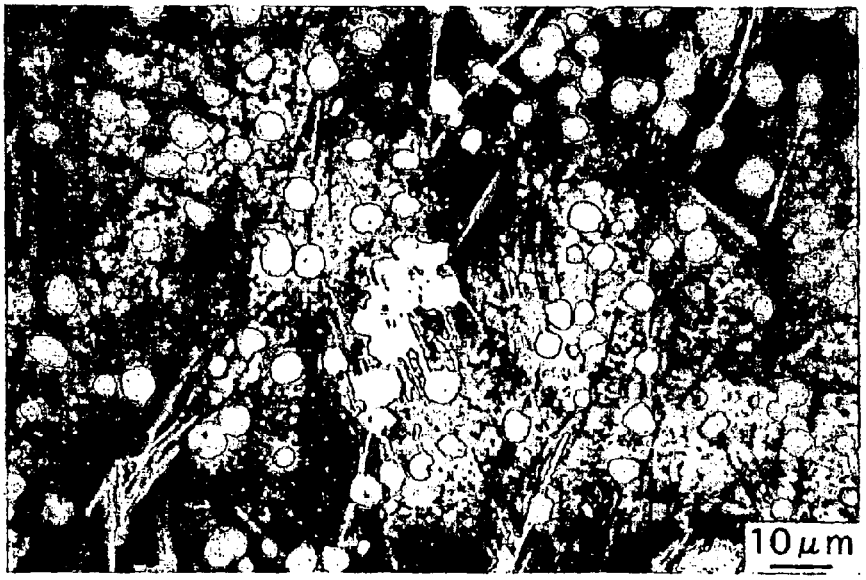
FIG. 16 is an optical micrograph of metal structure of Example 16.
Figure 17:
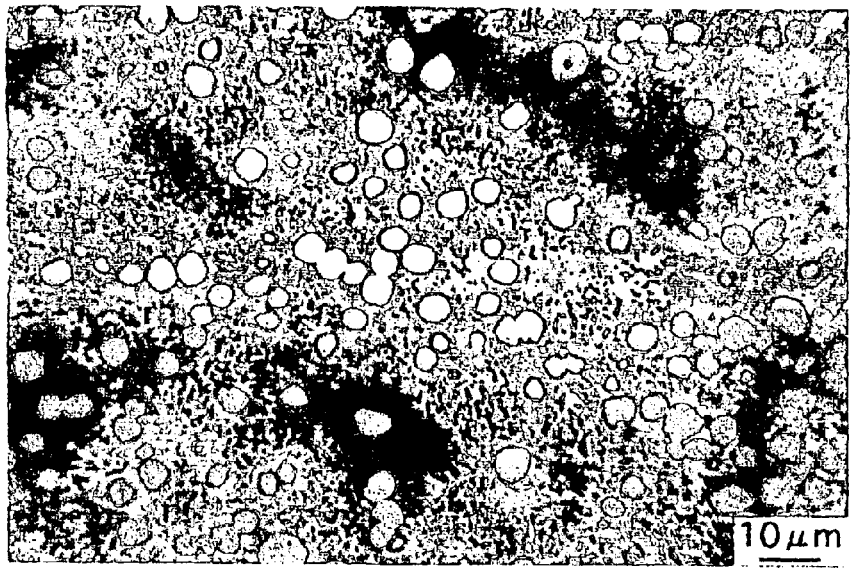
FIG. 17 is an optical micrograph of metal structure of Example 17.

Hereinafter, high manganese cast iron containing spheroidal vanadium carbide and method for making thereof which relates to the present invention is explained detail.

The high manganese cast iron containing spheroidal vanadium carbide which relates to the present invention consists of C 1.5~4.0 weight %, V 6~15 weight %, Si 0.2~4.0 weight %, Mn 10~18 weight %, Mg 0.01~0.1 weight %, remaining iron (Fe) and inevitable impurities.

Carbon(C) and vanadium(V) are added in order to crystallize spherioidal vanadium carbide. The content of carbon should be 1.5~4.0 weight %, preferably 1.9~3.5 weight %, more preferably 2.1~3.3 weight %. When the content is less than 1.5 weight %, the vanadium carbide which is not enough spheroidized increases, but when it is more than 1.5 weight %, spheroidization of the vanadium carbide is stabilized. Further, when the content is more than 4.0 weight %, a part of C becomes plate-like carbide of Fe—C system (i.e. cementite) which makes it lower toughness.

The content of vanadium should be 6.0~15 weight %, preferably 8~14 weight %, more preferably 9~13.5 weight %. When the content is less than 6.0 weight %, the vanadium carbide cannot be enough spheroidized, and no better effect can be expected with the content more than 15 weight % which it easily cause segregation on the contrary. Neither of the above cases are desirable. It should added that the content of V is as 3~6 times in weight as that of C, preferably about 3.5~5.5 times and more preferably about 4 times, since the ratio of atomicity is about 1:1 (weight ratio is 4:1) in spheroidal vanaium carbide.

Silicon (Si) and manganese (Mn) are added for improving mechanical properties such as castability, wear-resistance and toughness.

Silicone (Si) is added for oxidation prevention and deoxidation of molton metal in melting process and for castability. The content of silicone should be 0.2~4.0 weight %, preferably 0.5~4.0 weight % and more preferably 0.5~2.0 weight %. The reason is that if the content is less than 0.2 weight %, the effect by the Si containing cannot be shown because of decreasing of the yield of V, whereas toughness decreases when exceeding 4.0 weight %; therefore, neither cases are desirable.

Manganese (Mn) is contained so as to make a matrix to be the austenite. The content of manganese should be 10~18 weight %, preferably 11~16 weight % and more preferably 12~15 weight %. This reason is that if the content is less than 10 weight %, the matrix is difficult to become an austenite single-phase, and if it is more than 18 weight %, segregation of manganese tends to occur in as-cast conditions; therefore, neither of the cases are preferable.

Magnesium (Mg) is necessary to spheroidize vanadium carbide. The content of magnesium should be 0.01~0.1 weight %, preferably 0.02~0.08 weight % and more preferably 0.03~0.08 weight %. This reason is that if the content is less than 0.01 weight %, spheroidization of vanadium carbide is incomplete, and if it more than 0.1 weight %, much of an oxide of magnesium is scattered, and this is not desirable as material.

The above-mentioned elements are the necessary components that are contained in iron (Fe) of a main component. In addition, in the present invention, P and S can be contained in the above-mentioned necessary component. The content of phosphorous (P) should be 0.02~0.1 weight %, preferably 0.02~0.08 weight % and more preferably 0.02~0.06 weight %. This reason is that it is difficult to be the content less than 0.01 weight % in the materials used at present. On the other hand, if the content exceeds 0.1 weight %, segregation and brittleness occurs; therefore, neither of the cases are preferable.

The content of sulfur (S) should be 0.006~0.08 weight %, preferably 0.015~0.05 weight %. This reason is that it is difficult to be the content less than 0.006 weight % in the materials used at present, if it is more than 0.08 weight %, MnS (sulfuric manganese) tends to crystallize and wear-resistance lowers; therefore, neither of the cases are preferable.

Moreover, in the present invention, in addition to above-mentioned each components, an alloy element selected at least one or more kinds from the group consisting of (a) Ni 0.5~8.0 weight %, (b) Mo 0.5~4.0 weight %, (c) at least two or more kinds of alloy elements selected from the group consisting of Ta, Ti, W and Nb 0.5~3.5 weight %, (d) at least two or more kinds of alloy elements selected from the group consisting of Ca, Ba and Sr 0.01~0.1 weight %, can be contained.

When nickel (Ni) is contained, the content of Ni should be 0.5~8.0 weight %, preferably 0.5~6.0 weight % and more preferably 0.5~4.0 weight %. This reason is that if the content is less than 0.5 weight %, an effect by containing Ni cannot be obtained. On the other hand, if it is more than 8.0 weight %, segregation is remarkably occurred; therefore, neither of the cases are preferable.

Molybdenum (Mo) is effective in preventing crysatllization of primary graphite and in stabilizing the matrix. When containing Mo, its content should be 0.5~4.0 weight %, preferably 0.5~3.0 weight % and more preferably 0.5~2.0 weight %. This reason is that if the content is less than 0.5 weight %, an effect cannot be obtained by containing Mo and if it is more than 4.0 weight %, a carbide except for spheroidal vanadium carbide is crystallized; therefore, neither cases are preferable.

Tantalum (Ta), titanium (Ti), tungsten (W) and niobium (Nb) are effective in decreasing of amounts of nitrogen in molten iron and in refining metal strucure. Although it is effective even if these alloy elements are added independently, more than two alloy elements are added in the present invention, since combining and adding can obtain more excellent effect. However, since it is not effective even if these alloy elements are added at random, and total weight of the content is 0.5~3.5 weight %, preferably 0.5~2.0 weight % and more preferably 0.5~1.5 weight %.

Calcium (Ca), barium (Ba), and strontium (Sr) are added as Mg bubble stabilizer. Although Ca hardly melts into molten iron, a strong Ca—Si binding increases by adding Ca. Consequently, a melting point of Mg alloy rises and generation of microscopic Mg bubble in the molten iron can be processed smoothly.

Although a boiling point of Ba and Sr are higher than Mg, but a melting point is low. Therefore, an effect of dispersing microscopic Mg bubble can be obtained. Particularly, fading phenomenon generated in Mg can be relieved.

Although it is effective even if above-mentioned Ca, Ba and Sr are added independently, more excellent effect can be obtained by adding more than two kinds of alloy element. Therefore, in the present invention, when Ca, Ba and Sr are added, more than two kinds of alloy elements selected from the group consisting of Ca, Ba and Sr are added 0.01~0.1 weight %, preferably 0.01~0.08 weight % and more preferably 0.01~0.05 weight %.

Particularly, it is effective to add Ca, Ba and Sr for complete spheroidization of vanadium carbide, and to contain Mo, Ti, W, and Ta is effective for improving mechanical properties such as wear-resistance and toughness.

In order to manufacture the high manganese cast iron containing spheroidal vanadium carbide using the materials which consist of the above-mentioned compositions, which relates to the present invention, additing of Mg is fundamental. This reason is that since boiling point (1373 K) of Mg is comparatively low, it changes into Mg bubble in molten iron at 1773~2073 K. By adding Mg, microscopic spheroidal space of Mg bubble can be actively dispersed in the molten iron, and spheroidal vanadium carbide can be uniformly dispersed in a matrix by preferentially crystallizing covalent bonding spheroidal vanadium carbide in the spheroidal space of the Mg bubble. Consequently, Mg has extremely high ability of spheroidizing vanadium carbide, and Mg is fundamental for this alloy.

Pure magnesium, Mg alloy, chloride of Mg and the fluoride of Mg etc., can be used example of Mg, and a lump or briquette of Mg—Ni, Mg—Fe, Mg—Si—Fe, Mg—Cu, Mg—Al etc. can explain as examples of Mg alloy.

In other words, in order to manufacture high manganese cast iron containing spheroidal vanadium carbide which relates to the present invention, after melting the alloy materials which consist of the above-mentioned compositions except Mg at the temperature which generates Mg gas bubble, the molten iron is finally added with Mg and cast to molds.

Practical bubbling reaction temperature is 1773~2073 K, preferably 1773~1950 K and more preferably 1873~1950 K. Since microscopic magnesium bubble is not dispersed when melting temperature is less than 1773 K, spheroidal vanadium carbide is not formed, non-spheroidal vanadium carbide is crystallized in the matrix, castability of molten iron becomes worse and casting is difficult. On the other hand, when dissolution temperature is more than 2073 K, there is no problem in spheroidization, but yield of magnesium bubble lowers, and this is not desirable.

In the present invention, since spheroidal vanadium carbide, which is a hard particle, is contained by dispersing approximately all over the austenite matrix, and the present invention has superior mechanical properties such as wear-resistance and toughness to conventional high manganese steel (high manganese cast steel). Further, since almost all carbon is used to constitute crystallizing vanadium carbide, an amount of carbon in the matrix decreases remarkably. As a result, magnetic permeability in as-cast condition becomes about not over than 1.5, preferably about not over than 1.1, which is different to the conventional high manganese steel (high manganese cast steel), and nonmagnetic material can be obtained.

By a common procedure, the high manganese cast iron containing spheroidal vanadium carbide which is comprising from the above-mentioned composition can be obtained in as-cast condition through pouring molten iron into a casting mold. The as-cast structure is basically consisted of the austenite (γ) phase and vanadium carbide phase. The water toughing process is not needed in the present invention.

EXAMPLES

Following is a detailed explanation of the high manganese cast iron containing spheroidal vanadium carbide and method for making thereof disclosed in the present invention based on examples. Note that the present invention is not restricted to the following examples.

Conditions of Melting and Casting and Material to be Tested

According to the composition mentioned in Table 1, samples of Examples 1~17 and Comparative Examples 1 were prepared.

As for the method of preparing samples, said prepared samples are melted with using high frequency induction furnace of 5 Kg capacity in melting weight (magnesia crucible). About Examples 1~17, after alloy elements except Mg were melted with increasing the temperature to 1923 K., Mg was added and, micro structure observation test pieces, mechanical test pieces (60×10×70 mm) and wear-resistance test pieces (55×55×11 mm) were cast to the sand mold at 1873 K.

Sample of Comparative Example 1 is a general structural rolled steel called SS400, which is regulated by JISG-3101.

Sample of Comparative Example 2 was melted with using high frequency induction furnace of 100 Kg capacity in melting weight (ramming material MgO). After alloying material were melted with increasing the temperature to 1923 K., micro structure observation test pieces, mechanical test pieces (60×10×70 mm) and wear-resistance test pieces (55×55×11 mm) were cast to the sand mold at 1873 K., and then water toughening treatment was carried out at 1323 K. Comparative Example 2 is high manganese cast steel corresponding to JIS G-5131 SCMnH2.

TABLE 1

| | Example 1 | Example 2 | Example 3 | Example 4 | Example 5 | Example 6 | Example 7 | Example 8 | Example 9 |
|---|---|---|---|---|---|---|---|---|---|
| C | 2.1 | 2.1 | 2.1 | 2.4 | 2.4 | 2.4 | 2.7 | 2.7 | 2.7 |
| V | 6.0 | 8.0 | 10.0 | 6.0 | 8.0 | 10.0 | 8.0 | 10.0 | 12.8 |
| Si | 0.5 | 0.5 | 0.5 | 0.5 | 0.5 | 0.5 | 0.5 | 0.5 | 0.5 |
| Mn | 13.0 | 13.0 | 13.0 | 13.0 | 13.0 | 13.0 | 13.0 | 13.0 | 13.0 |
| Mg | 0.05 | 0.05 | 0.05 | 0.05 | 0.05 | 0.05 | 0.05 | 0.05 | 0.05 |
| Fe + Impurities | Remaining | Remaining | Remaining | Remaining | Remaining | Remaining | Remaining | Remaining | Remaining |
| Total | 100.0 | 100.0 | 100.0 | 100.0 | 100.0 | 100.0 | 100.0 | 100.0 | 100.0 |

TABLE 2

| | Example 10 | Example 11 | Example 12 | Example 13 | Example 14 | Example 15 | Example 16 | Example 17 | Comparative Example 1 | Comparative Example 2 |
|---|---|---|---|---|---|---|---|---|---|---|
| C | 3.0 | 3.0 | 3.0 | 3.3 | 3.3 | 3.3 | 3.5 | 3.5 | 0.2 | 1.0 |
| V | 8.0 | 10.0 | 12.8 | 8.0 | 10.0 | 12.8 | 10.0 | 12.8 | 0 | 0 |
| Si | 0.5 | 0.5 | 0.5 | 0.5 | 0.5 | 0.5 | 0.5 | 0.5 | 0.2 | 0.5 |
| Mn | 13.0 | 13.0 | 13.0 | 13.0 | 13.0 | 13.0 | 13.0 | 13.0 | 0.5 | 13.0 |
| Mg | 0.05 | 0.05 | 0.05 | 0.05 | 0.05 | 0.05 | 0.05 | 0.05 | 0.05 | — |
| Fe + Impurities | Remaining | Remaining | Remaining | Remaining | Remaining | Remaining | Remaining | Remaining | Remaining | Remaining |
| Total | 100.0 | 100.0 | 100.0 | 100.0 | 100.0 | 100.0 | 100.0 | 100.0 | 100.0 | 100.0 |

(Test 1)

Observation with Optical Microscope

To observe a micro structure, a portion of 12 mm from the side part of materials to be tested of Examples 1~17 and Comparative Example 2, which were prepared in the above methods, were cut and observed with the optical microscope after polishing.

The results of Examples 1~17 and Comparative Example 2 are shown in FIGS. 1~18 respectively.

Figure 18:
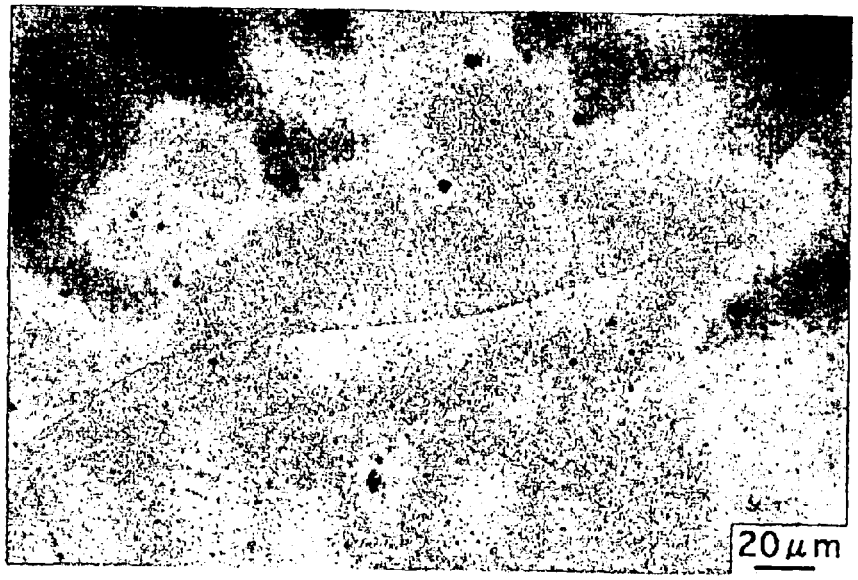
FIG. 18 is an optical micrograph of metal structure of Comparative Example 2.

As shown in FIGS. 1~17, spheroidal crystallized substances in the structure of samples of Examples were confirmed. On the other hand, as indicated in FIG. 18, spheroidal crystallized substances in the structures of samples of Comparative Example 2 were not confirmed.

(Test 2)

Measurement of Hardness

The hardness of alloyed cast iron obtained in said Examples 1~17 and in said Comparative Example 1 were tested. "C scale ($H_RC$)" of "Rockwell hardness ($H_R$)" as an index was used in the test in accordance with "The method of Rockwell hardness test" as shown in "JISZ 2245" (i.e. In order to calculate the hardness with definite equation, differences between depths of indenter trespass at rated load before and after the test load is added onto the test piece can be measured within the following processes; firstly, a rated load is added onto a test pieces, and further a test load is added, and then the test piece was brought back to with rated load again, using diamond indenters and spheroidal indenters).

The result of the measurement of hardness is shown in Table 3.

TABLE 3

| | Example 1 | Example 2 | Example 3 | Example 4 | Example 5 | Example 6 | Example 7 | Example 8 | Example 9 |
|---|---|---|---|---|---|---|---|---|---|
| $H_RC$ | 35.1 | 32.4 | 36.0 | 40.1 | 33.0 | 33.6 | 39.1 | 32.6 | 36.2 |
| | Example 10 | Example 11 | Example 12 | Example 13 | Example 14 | Example 15 | Example 16 | Example 17 | Comparative Example2 |
| $H_RC$ | 41.3 | 39.0 | 32.0 | 43.4 | 41.2 | 35.3 | 42.1 | 34.9 | 8.8 |

(Test 3)

Wear Resistance Test

Sand blasting test using a sand blast machine (SGK-3), which is manufactured by Fuji Manufactory Co., Ltd., was carried out and wear-resistances of samples were evaluated. Samples (55×55×11 mm) of Comparative Examples 1~2 and Examples 1~17 were attached to the sand blast machine and blast materials were impacted to materials to be tested on the following conditions. Wear weight losses of samples after sand blasting test were measured and wear craters were compared.

Conditions to Impact Blast Materials

Blast materials is that martensite steel shot 180 $\mu$mϕ, impact pressure is 0.466 MPa, impact angle is that 30°, 45°, 60°, 90°, impact quantity rate of blast material is $3.57\times10^{-2}$ kg/s, impact time is 1.8 ks, distance between impact nozzle and materials to be tested is $5\times10^{-2}$ m, diameter of impact nozzle is $7\times10^{-3}$ m Wear weight losses were shown in Table 4 when impact angles were 30°, 45°, 60°, and 90° respectively.

Figure 19:
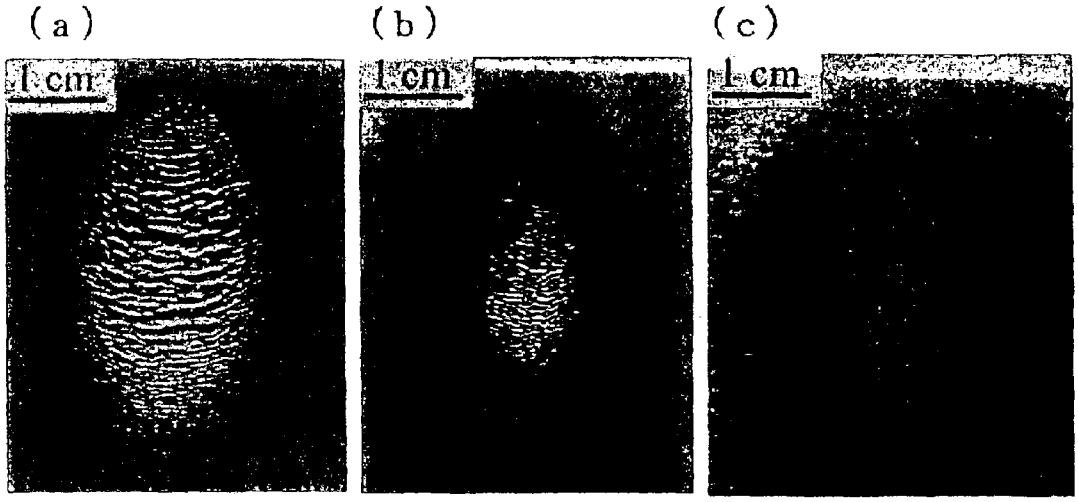
FIGS. 19(*a*), (*b*), and (*c*) are pictures of wear-craters observed at sample surface after sand blasting test. (a) (b) and (c) are pictures of samples of Comparative Example 1, Comparative Example 2, and Example 11 respectively.
Figure 20:
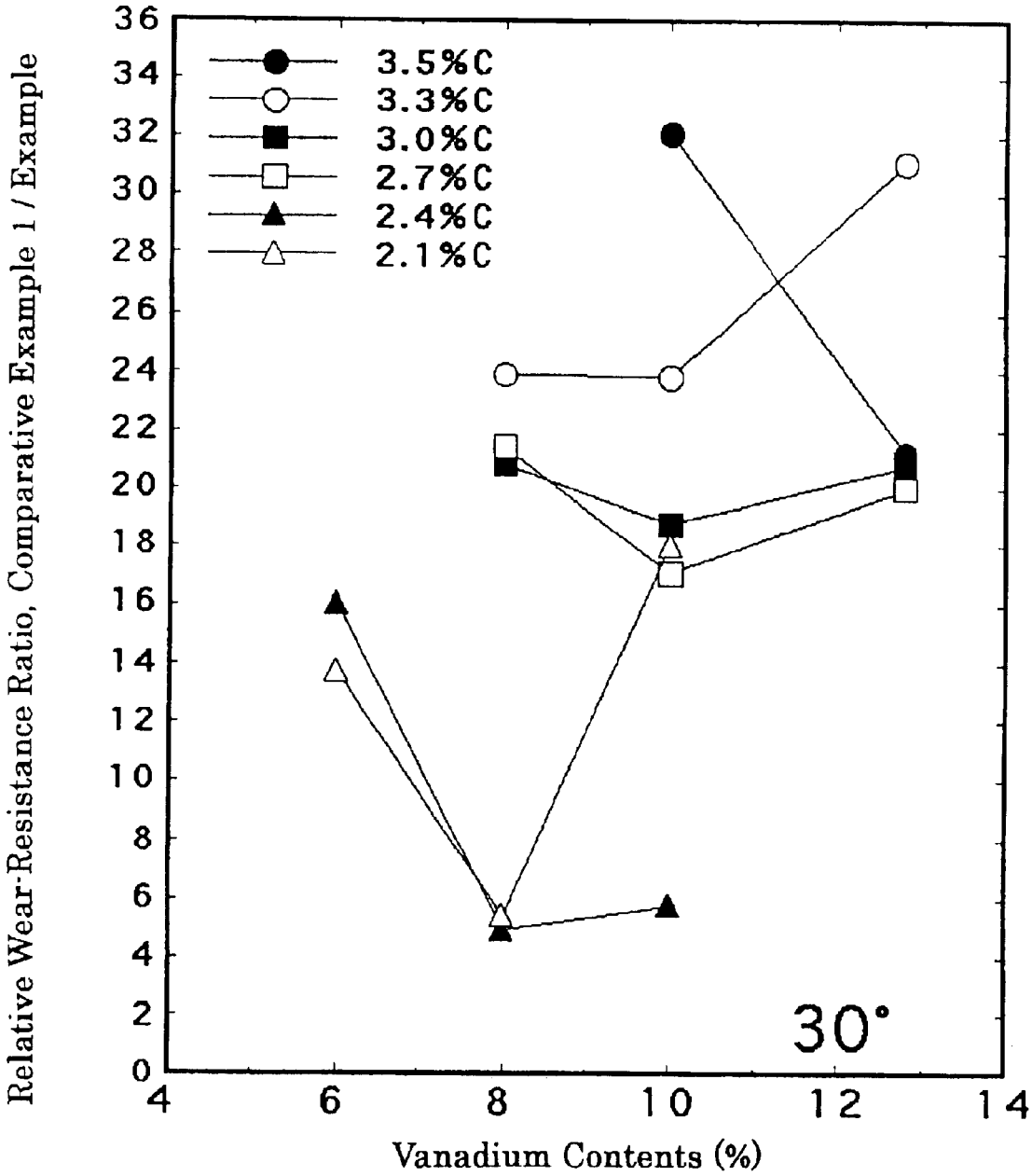
FIG. 20 is a graph showing that the relative wear-resistance ratio, which was calculated to divide wear weight losses of Comparative Example 1 by wear weight losses of Examples, were described in relation to vanadium contents and carbon contents when angle to impact blast materials (impact angle) was 30°.
Figure 21:
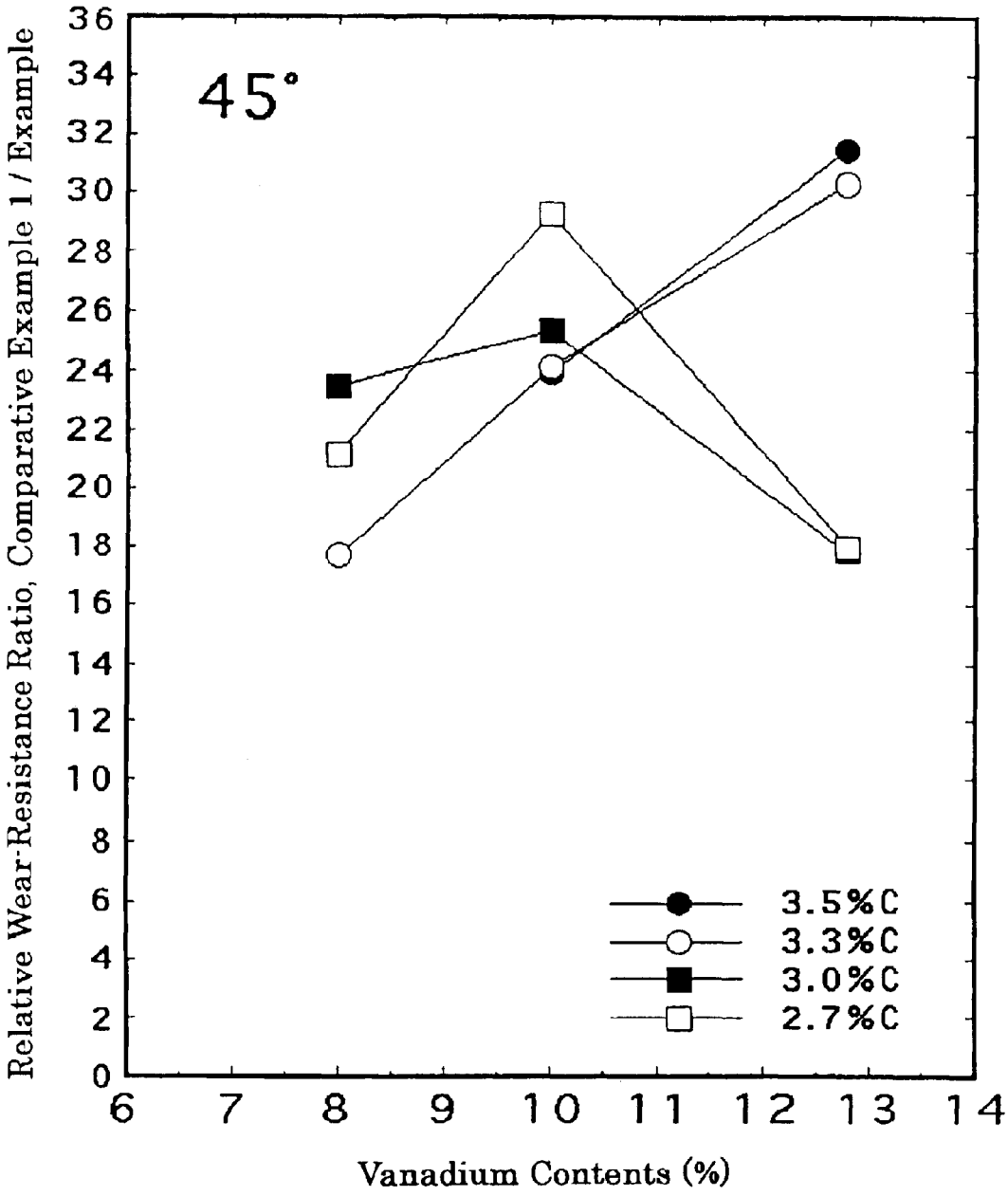
FIG. 21 is a graph showing that the relative wear-resistance ratio, which was calculated to divide wear weight losses of Comparative Example 1 by wear weight losses of Examples, were described in relation to vanadium contents and carbon contents when impact angle was 45°.
Figure 22:
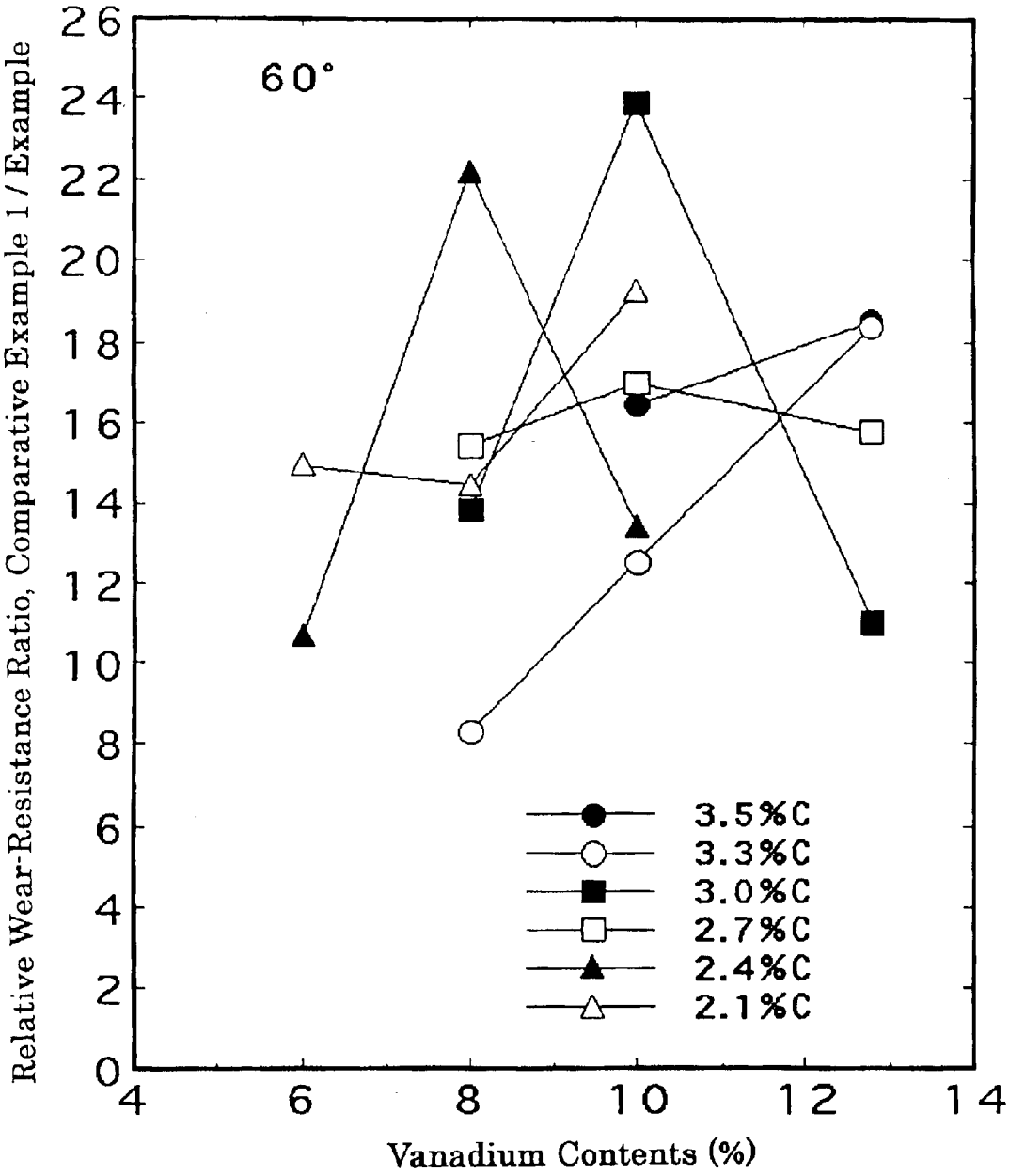
FIG. 22. is a graph showing that the relative wear-resistance ratio, which was calculated to divide wear weight losses of Comparative Example 1 by wear weight losses of Examples, were described in relation to vanadium contents and carbon contents when impact angle was 60°
Figure 23:
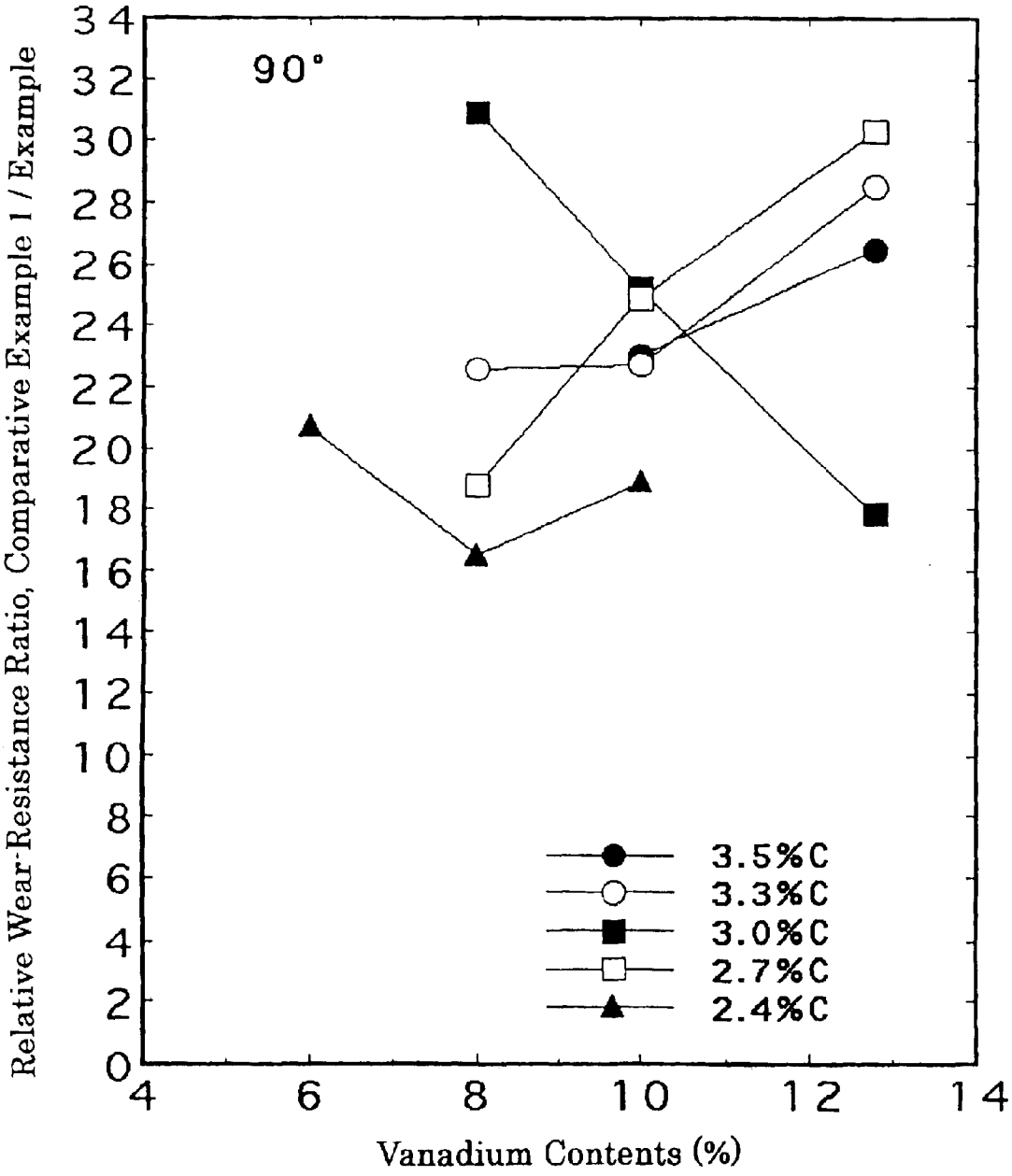
FIG. 23 is a graph showing that the relative wear-resistance ratio, which was calculated to divide wear weight losses of Comparative Example 1 by wear weight losses of Examples, were described in relation to vanadium contents and carbon contents when impact angle was 90°.
Figure 24:
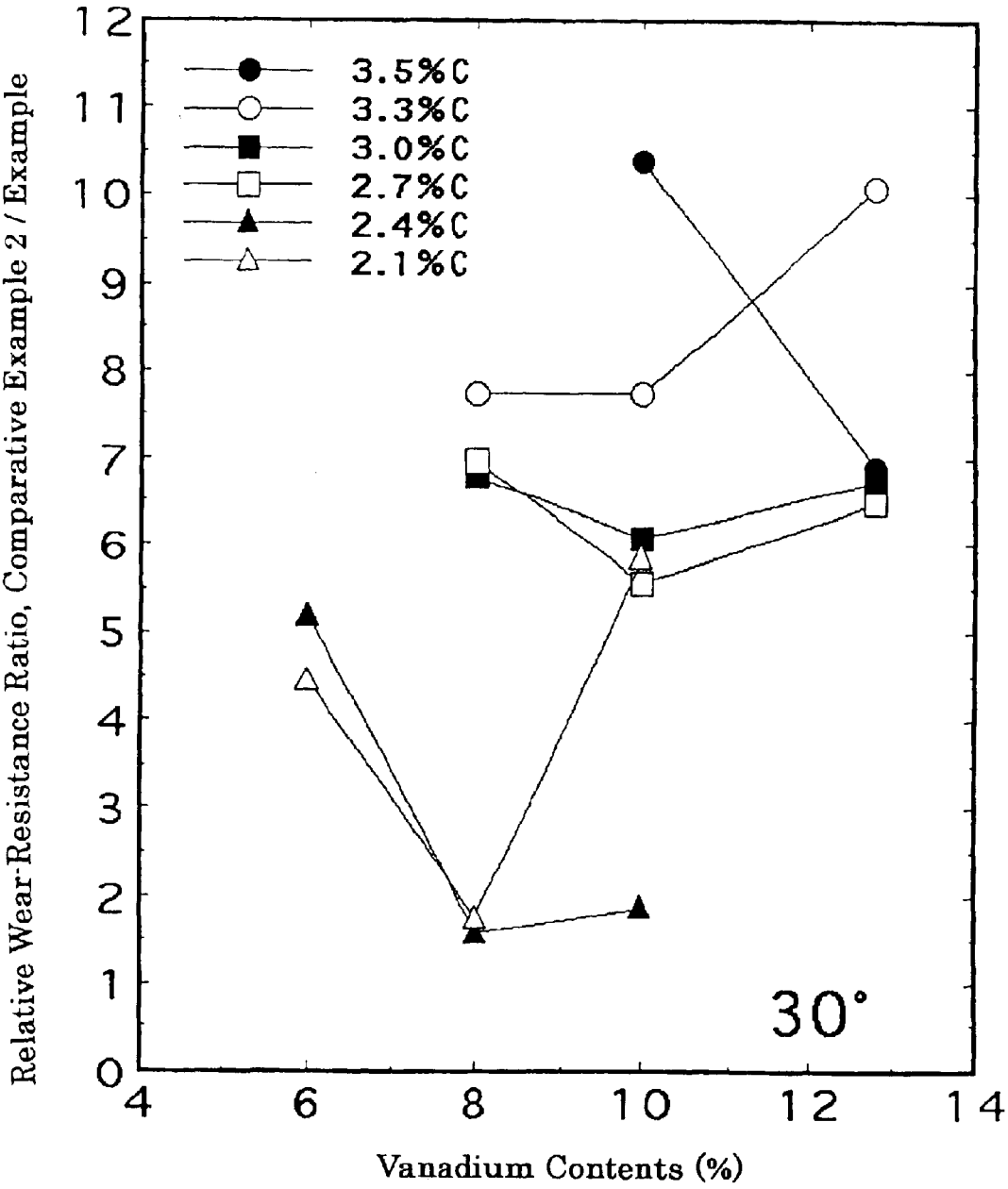
FIG. 24 is a graph showing that the relative wear-resistance ratio, which was calculated to divide wear weight losses of Comparative Example 2 by wear weight losses of Examples, were described in relation to vanadium contents and carbon contents when impact angle was 30°.
Figure 25:
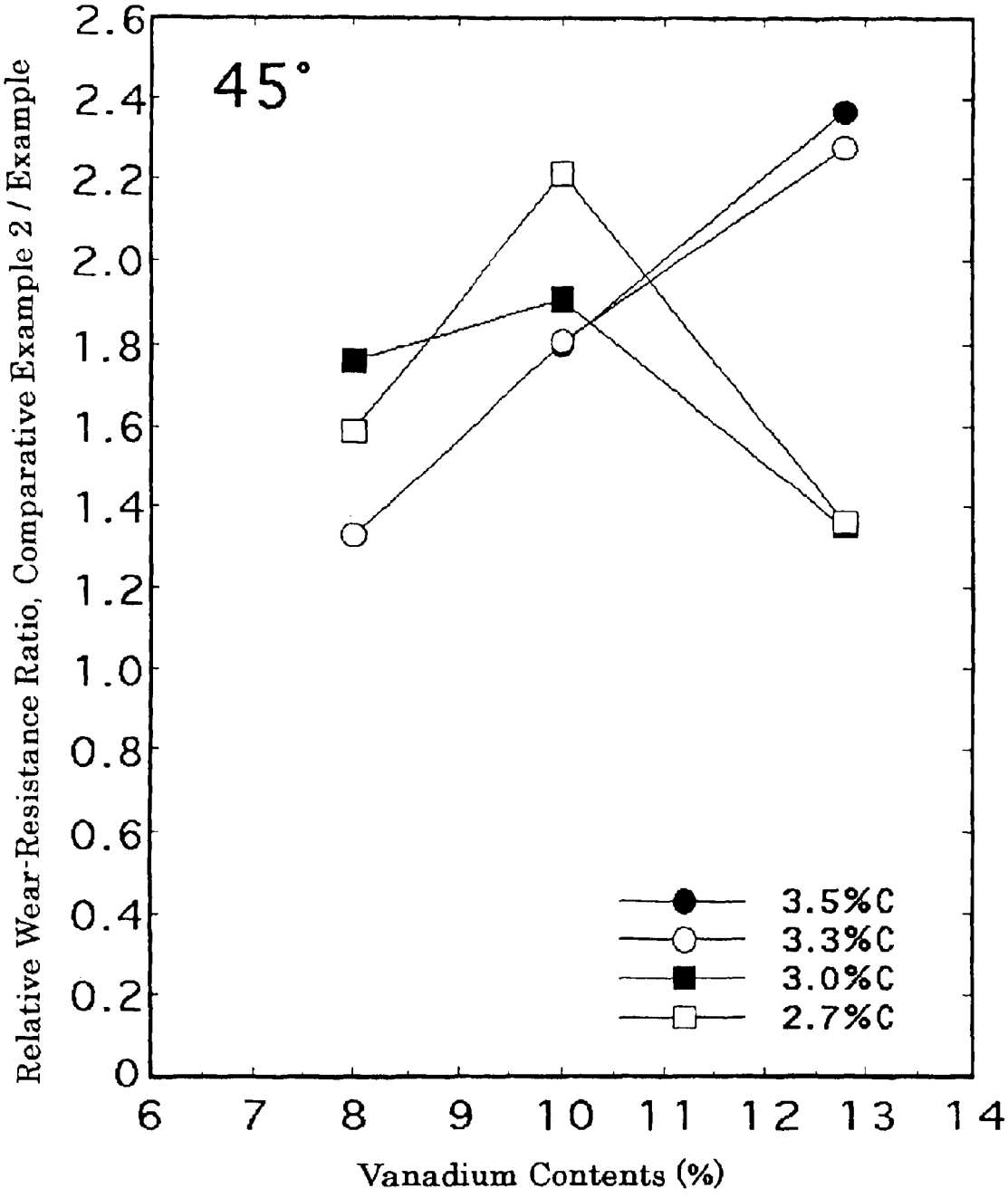
FIG. 25 is a graph showing that the relative wear-resistance ratio, which was calculated to divide wear weight losses of Comparative Example 2 by wear weight losses of Examples, were described in relation to vanadium contents and carbon contents when impact angle was 45°.
Figure 26:
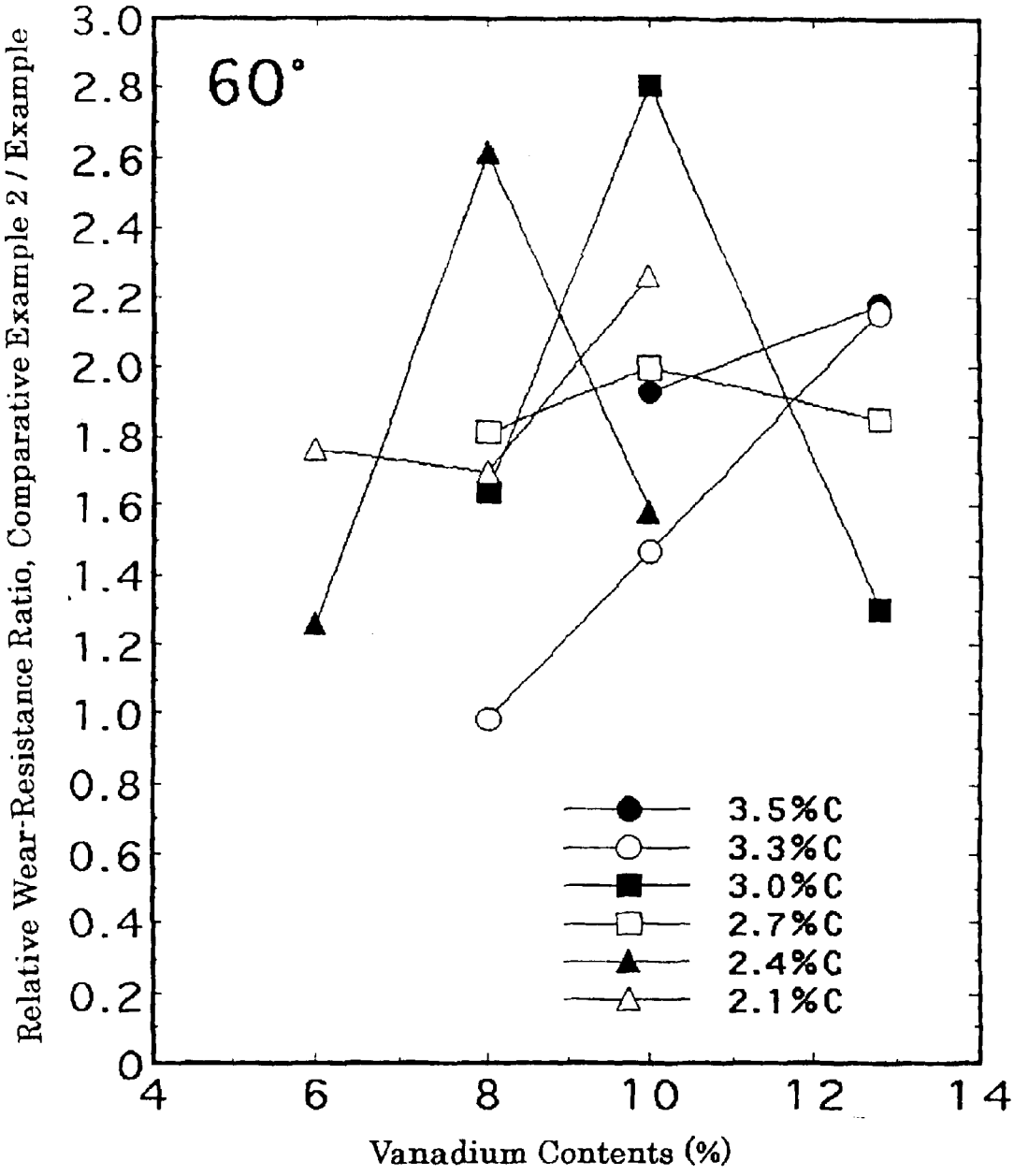
FIG. 26 is a graph showing that the relative wear-resistance ratio, which was calculated to divide wear weight losses of Comparative Example 2 by wear weight losses of Examples, were described in relation to vanadium contents and carbon contents when impact angle was 60°.
Figure 27:
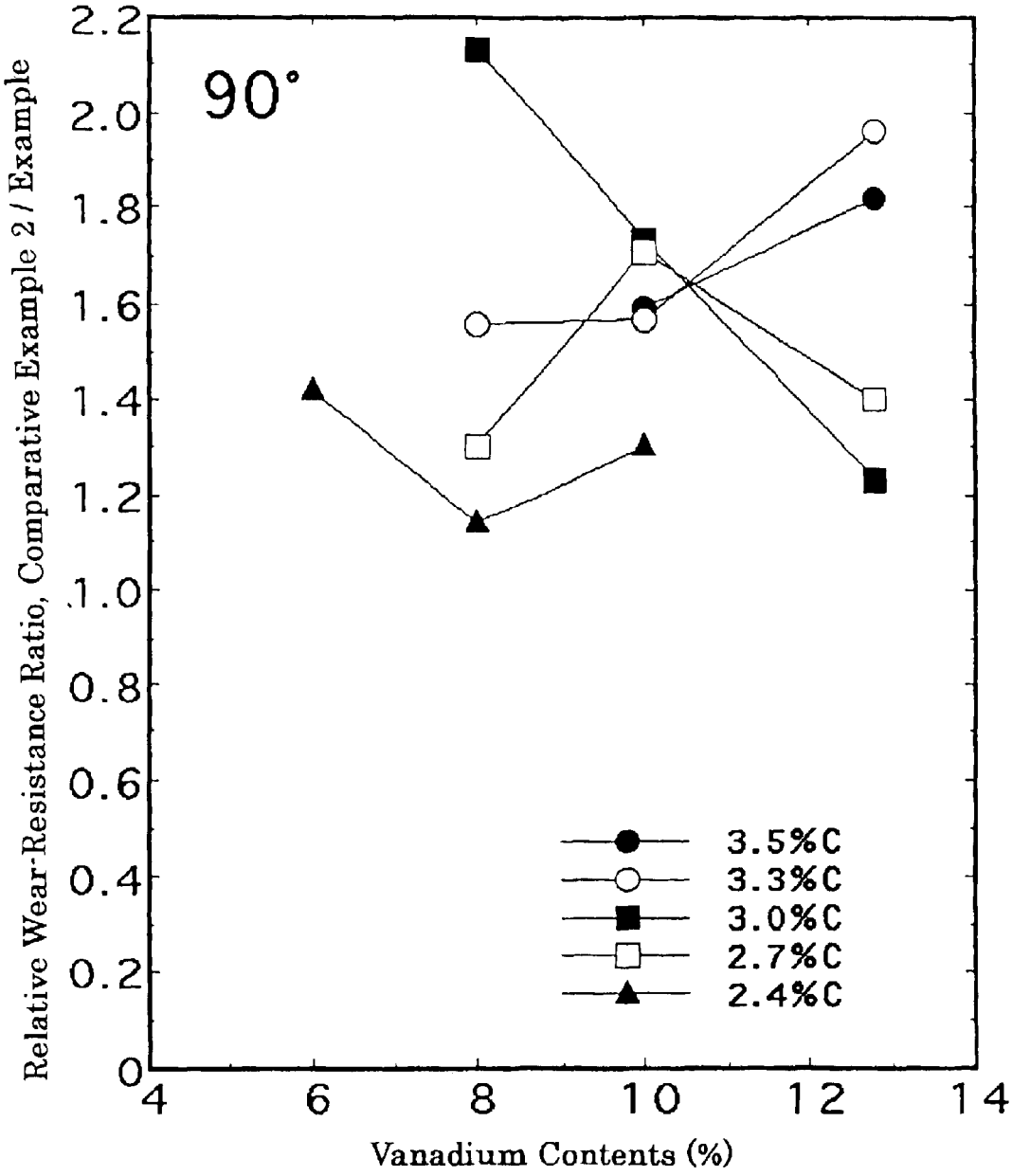
FIG. 27 is a graph showing that the relative wear-resistance ratio, which was calculated to divide wear weight losses of Comparative Example 2 by wear weight losses of Examples, were described in relation to vanadium contents and carbon contents when impact angle was 90°.

Pictures of wear-craters observed at samples surface of Comparative Examples 1~2 and Examples 11 after wear-resistance test were shown in (a), (b) and (c) of FIG. 19.

Wear-resistance properties of samples were shown in FIGS. 20~29. FIGS. 20~23 were graphs showing that the relative wear-resistance ratio, which was calculated to divide wear weight losses of Comparative Example 1 by wear weight losses of Examples, were described in relation to vanadium contents and carbon contents when angles to impact blast materials (impact angles) were 30°, 45°, 60°, and 90° respectively.

FIGS. 24~27 were graphs showing that the relative wear-resistance ratio, which was calculated to divide wear weight losses of Comparative Example 2 by wear weight losses of Examples, were described in relation to vanadium contents and carbon contents when impact angles were 30°, 45°, 60°, and 90° respectively.

Figure 28:
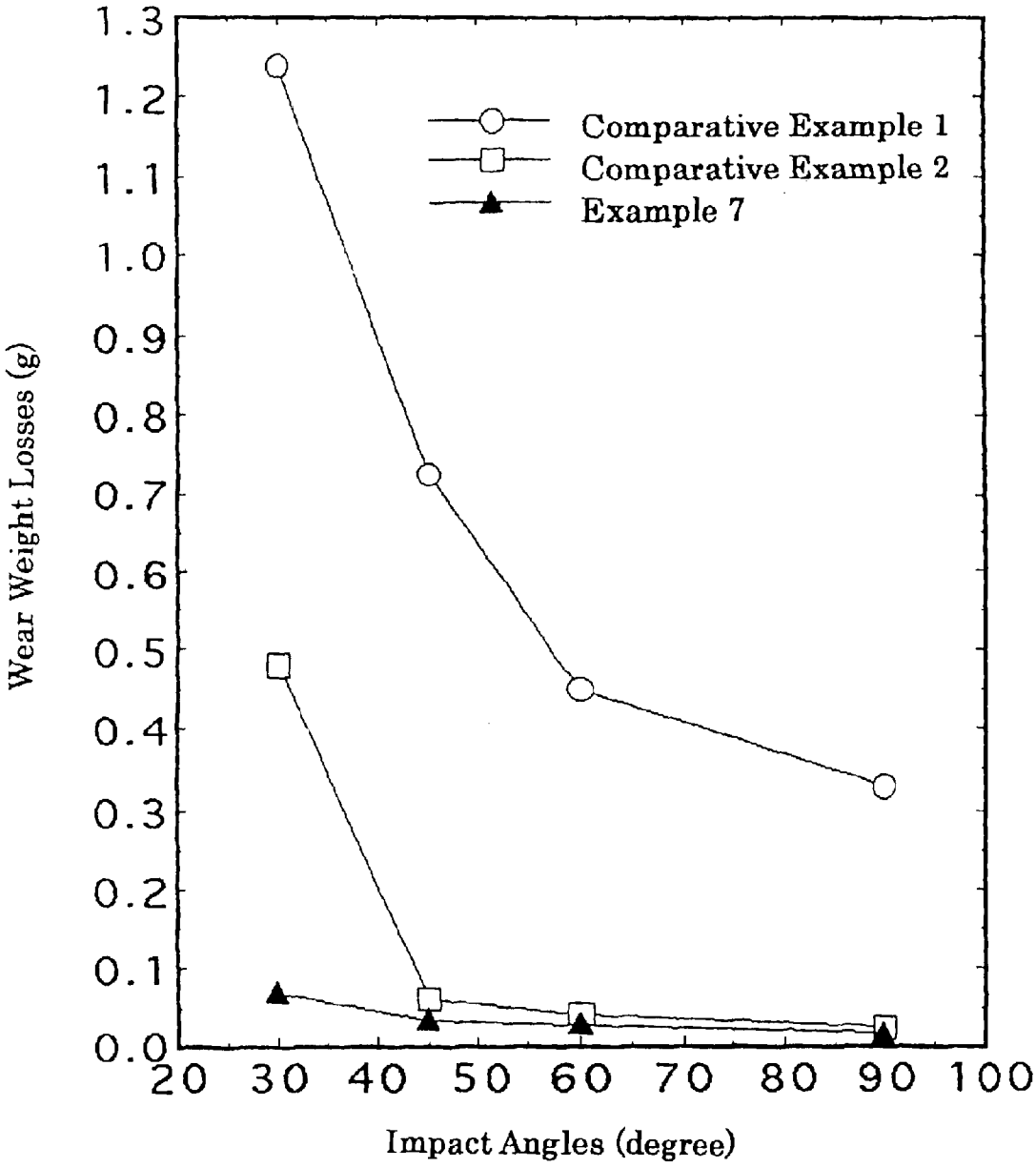
FIG. 28 is a graph of Example 7 putting down with wear weight losses (g) of Comparative Example 1 and Comparative Example 2 in a graph taking the wear weight losses (g) as vertical axis and the angles to impact blast materials (impact angle) as horizontal axis.
Figure 29:
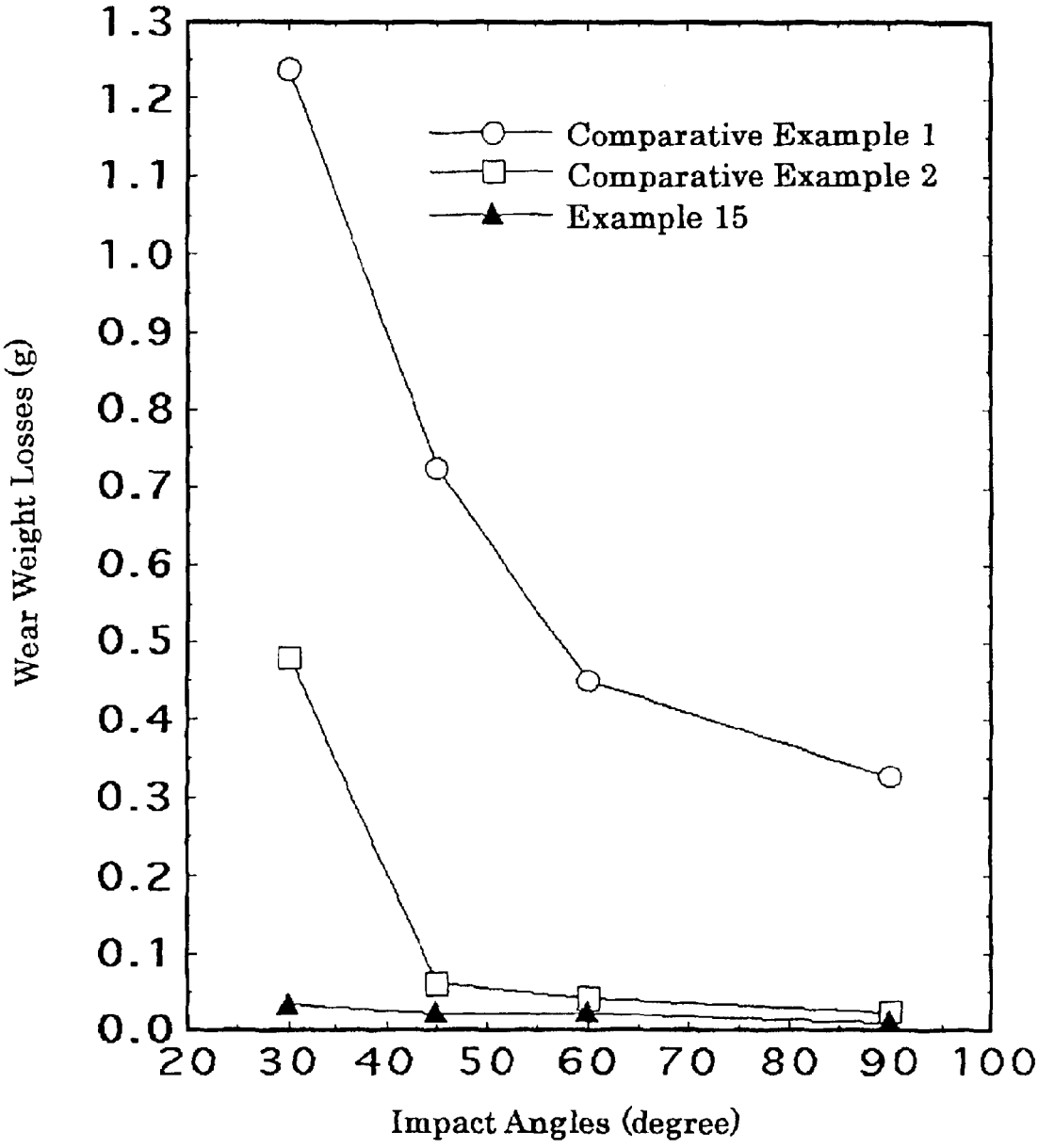
FIG. 29 is a graph of Example 15 putting down with wear weight losses (g) of Comparative Example 1 and Comparative Example 2 in a graph taking the wear weight losses (g) as vertical axis and the angles to impact blast materials (impact angle) as horizontal axis.

FIGS. 28 and 29 were graphs of Example 7 and Example 15 respectively putting down with wear weight losses (g) of Comparative Example 1 and Comparative Example 2 in a graph taking the wear weight losses (g) as vertical axis and the impact angles as horizontal axis.

TABLE 4

| | Wear weight losses (g) | | | |
|---|---|---|---|---|
| Impact angle | 30° | 45° | 60° | 90° |
| Example 1 | 0.09 | — | 0.0321 | — |
| Example 2 | 0.23 | — | 0.0333 | — |
| Example 3 | 0.08 | — | 0.0266 | — |
| Example 4 | 0.09 | — | 0.0479 | 0.0146 |
| Example 5 | 0.27 | — | 0.0211 | 0.0183 |
| Example 6 | 0.23 | 0.0319 | 0.0349 | 0.0157 |
| Example 7 | 0.07 | 0.0337 | 0.0263 | 0.0158 |
| Example 8 | 0.07 | 0.0242 | 0.0239 | 0.0139 |

TABLE 4-continued

| | Wear weight losses (g) | | | |
|---|---|---|---|---|
| Impact angle | 30° | 45° | 60° | 90° |
| Example 9 | 0.06 | 0.0394 | 0.0265 | 0.017 |
| Example 10 | 0.0478 | 0.0323 | 0.0307 | 0.011 |
| Example 11 | 0.08 | 0.0276 | 0.0175 | 0.0135 |
| Example 12 | 0.0434 | 0.0423 | 0.0336 | 0.016 |
| Example 13 | 0.0427 | 0.0395 | 0.0551 | 0.0154 |
| Example 14 | 0.0428 | 0.0287 | 0.0367 | 0.0153 |
| Example 15 | 0.0322 | 0.0228 | 0.0231 | 0.0122 |
| Example 16 | 0.0298 | 0.0296 | 0.0289 | 0.0151 |
| Example 17 | 0.045 | 0.0224 | 0.0256 | 0.0137 |
| Comparative Example 1 | 1.24 | 0.7259 | 0.4509 | 0.3285 |
| Comparative Example 2 | 0.48 | 0.0606 | 0.048 | 0.025 |

As indicated in Table 4 and FIGS. 20~29, wear-resistance of samples of Example is superior to that of general structural rolled steel (SS400) of Comparative Example 1 and high manganese cast steel SCMnH2 of Comparative Example 2.

(TEST 4)

X-Ray Diffraction Test

X-ray diffraction test of samples was carried out on the conditions below in order to identify matrix structure and crystallization phase of Examples prepared in the above method.

Figure 30:
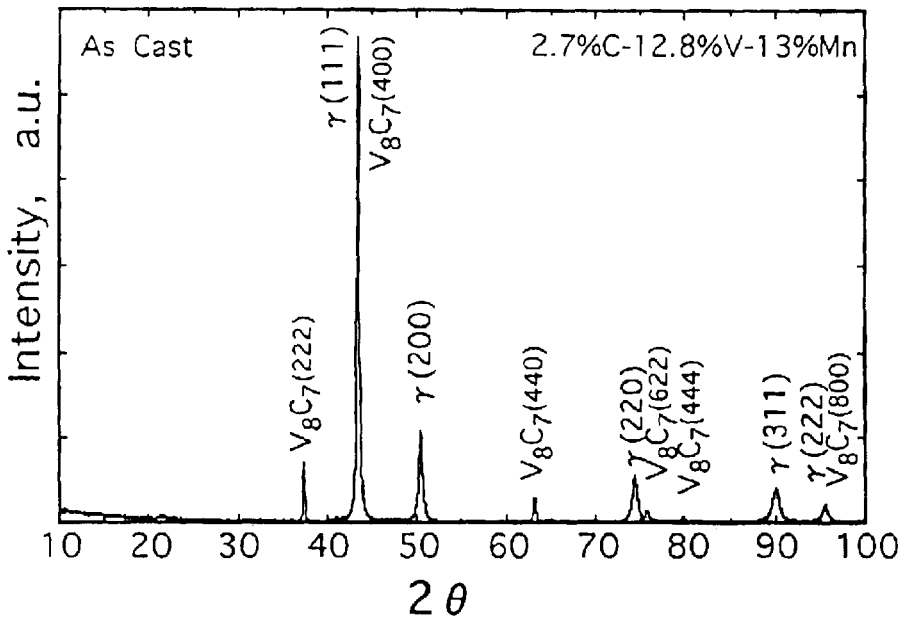
FIG. 30 is a result of X-ray diffraction test of Example 9.
Figure 31:
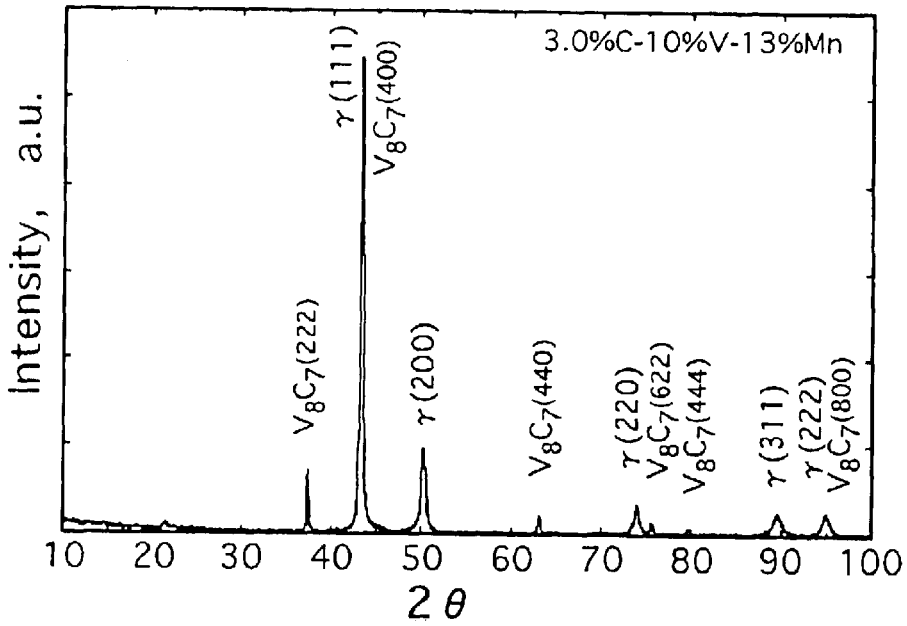
FIG. 31 is a result of X-ray diffraction test of Example 11.

Radiation source is Cuk α 40 kV 150 mA, counter is scintillation counter, scan speed is 4.000 deg/min, scan step is 0.020 deg/step, scanning axis is 2θ, scanning range is 10.000~100.000 deg As for one example of the results, X-ray diffraction results of Example 9 and 11 were shown in FIGS. 30 and 31 respectively.

As shown in FIGS. 30 and 31, X-ray diffraction results of samples of Examples indicated that matrix structure of Examples 9 and 11 were identified as austenite matrix, and crystallized substances as vanadium carbide.

(TEST 5)

Magnetic Permeability Measurement Test

Magnetization M (emu) of 5 mmϕ×5 mm sample (demagnetization factor (k)=0.27 (MKSA)) in applied magnetic field Ho (Oe) was measured using Vibrating Sample Magnetometer (model BHV-50H), which was manufactured by Riken Denshi Co., Ltd.

Effective magnetic field Hoff (Oe) and magnetic flux density B (Gauss) were calculated using the following equation 1 (Formula 1).

[Formula 1]

$$H_{eff}=Ho-kI$$

$$B=I+H_{eff}$$

(I=4πM/V (Gauss), and V means sample volume ($cm^3$))

Magnetic permeability ($\mu$) was calculated using the following equation 2 (Formula 2).

[Formula 2]

$$\mu = B/H_{eff}$$

Figure 32:
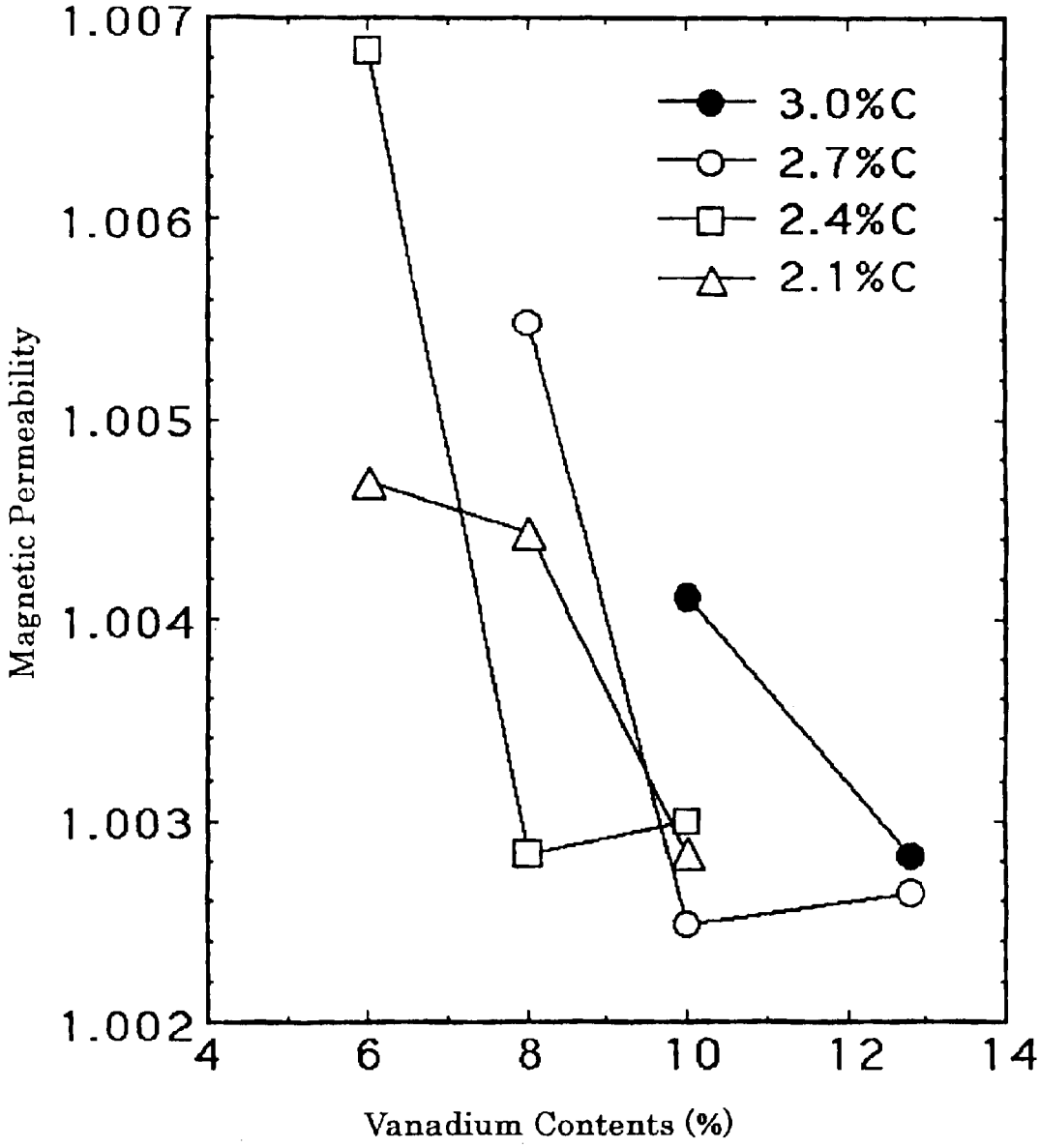
FIG. 32 is a graph showing the effect of vanadium contents and carbon contents on magnetic permeability ($\mu$).

FIG. 32 shows the effect of vanadium contents and carbon contents on magnetic permeability ($\mu$).

As indicated in FIG. 32, magnetic permeability of samples of Examples is less than 1.007, and samples of Examples are nonmagnetic.

Effects of the Present Invention

As explained in detail above, the high manganese cast iron containing spheroidal vanadium carbide and method for making thereof in the invention as set forth in claim 1 shows that the high manganese cast iron containing spheroidal vanadium carbide, which is nonmagnetic as well as superior mechanical properties such as wear-resistance, toughness and so forth, can be obtained by crystallizing spheroidal vanadium carbide in austenite matrix.

The high manganese cast iron containing spheroidal vanadium carbide and method for making thereof in the invention as set forth in claim shows that the high manganese cast iron containing spheroidal vanadium carbide which has improved mechanical properties such as wear-resistance, toughness and so forth can be obtained in accordance with purposes.

The high manganese cast iron containing spheroidal vanadium carbide and method for making thereof in the invention as set forth in claim 3, 4, 5 and 6 shows that the high manganese cast iron containing spheroidal vanadium carbide, which is nonmagnetic as well as superior mechanical properties such as wear-resistance, toughness and so forth, can be obtained by crystallizing spheroidal vanadium carbide in austenite matrix. It also does not need for water toughening heat treatment which is necessary when obtaining nonmagnetic high manganese steel, and can be produced in an as-cast condition after melting and casting alloy raw materials.

What is claimed is:

1. High Manganese cast iron containing spheroidal vanadium carbide wherein, comprising C 1.5~4.0 weight %, V 6~15 weight %, Si 0.2~4.0 weight %, Mn 10~18 weight %, Mg 0.01~0.1 weight %, remaining iron (Fe) and inevitable impurities, and within its structure, spheroidal vanadium carbide is crystallized.

2. High Manganese cast iron containing spheroidal vanadium carbide wherein, comprising an alloy element selected at least one or more kinds from the group consisting of a to d, (a) Ni 0.5~8.0 weight %, (b) Mo 0.5~4.0 weight %, (c) at least two or more kinds of alloy elements selected from the group consisting of Ta, Ti, W and Nb 0.5~3.5%, (d) at least two or more kinds of alloy elements selected from the group consisting of Ca, Ba and Sr 0.01~0.1 weight %, and C 1.5~4.0 weight %, V 6~15 weight %, Si 0.2~4.0 weight %, Mn 10~18 weight %, Mg 0.01~0.1 weight %, remaining iron (Fe) and inevitable impurities, and within a matrix, spheroidal vanadium carbide is crystallized.

3. Method for making high manganese cast iron containing spheroidal vanadium carbide comprising the steps of melting an alloy material containing C 1.5~4.0 weight %, V 6~15 weight %, Si 0.2~4.0 weight %, Mn 10~18 weight %, Mg 0.01~0.1 weight %, remaining iron (Fe) and inevitable impurities at 1773 K–2073 K, adding 0.01–0.1 weight %, Mg to the melted alloy material, and casting said alloy material.

4. Method for making high manganese cast iron containing spheroidal vanadium carbide as recited in claim 3 wherein, an additional alloy element is added, said additional alloy element selected from the group consisting of at least one or more kinds from the group consisting of a to d;

(a) Ni 0.5~8.0 weight %, (b) Mo 0.5~4.0 weight %, (c) at least two or more kinds of alloy elements selected from the group consisting of Ta, Ti, W and Nb 0.5~3.5%, and (d) at least two or more kinds of alloy elements selected from the group consisting of Ca, Ba and Sr 0.01~0.1 weight %.

5. Method for making high manganese cast iron containing spheroidal vanadium carbide described in claim 3 wherein, said alloy material is provided for use in an as-cast condition after melting at 1773~2073 K and casting.

6. Method for making high manganese cast iron containing spheroidal vanadium carbide described in claim 4 wherein, said alloy material is provided for use an in as-cast condotion after melting at 1773~2073 K and casting.

* * * * *